US005766267A

United States Patent [19]

Schumacher et al.

[11] Patent Number: 5,766,267

[45] Date of Patent: Jun. 16, 1998

[54] USE OF CARBOHYDRATE COMPOUNDS AS AUXILIARIES FOR DYEING AND PRINTING FIBER MATERIALS

[75] Inventors: Christian Schumacher, Kelkheim; Brigitte Hörsch, Kriftel; Andreas Von Der Eltz, Frankfurt am Main; Karl Bredereck, Stuttgart; Markus Strauss, Leutenbach, all of Germany

[73] Assignee: Hoechst Aktiengesellschaft, Germany

[21] Appl. No.: 647,839

[22] Filed: May 15, 1996

[30] Foreign Application Priority Data

May 15, 1995 [DE] Germany ..... 195 17 794.0

[51] Int. Cl.[6] ..... D06P 1/48

[52] U.S. Cl. ..... 8/532; 8/539; 8/543; 8/561; 8/918; 8/924

[58] Field of Search ..... 8/561, 543–549; 106/20 R–28 A

[56] References Cited

U.S. PATENT DOCUMENTS 5,006,170 4/1991 Schwartz et al. ..... 106/20

*Primary Examiner*—Margaret Einsmann
*Attorney, Agent, or Firm*—Connolly and Hutz

[57] ABSTRACT

Use of carbohydrate compounds as auxiliaries for dyeing and printing fiber materials Use of carbohydrate compounds of the formula (1)

$$Z—G—T—R^1_n \quad (1)$$

in which

Z is the radical of a carbohydrate from the series consisting of mono-, di- or oligosaccharides or of a sugar alcohol, the free valency being on a carbon atom;

G is a bridge member from the series consisting of —O—, —$NR^5$—, —O—CO—, —$NR^5$—CO— and —$NR^5$—$SO_2$—, in which $R^5$ is hydrogen or $C_1$—$C_4$-alkyl, which can be substituted by 1 to 4 radicals from the series consisting of hydroxyl, sulfo, sulfato or carboxyl;

T is a $C_4$–$C_{30}$-aliphatic, cycloaliphatic or oiefinic hydrocarbon radical, or is $C_6$–$C_{10}$-aryl or is $C_6$–$C_{10}$-aryl-$C_1$–$C_4$alkylene;

$R^1$ is hydroxyl, carboxyl, cyano,$C_1$–$C_4$-alkyl,$C_1$–$C_4$-alkoxy, sulfo, $C_1$–$C_{10}$-alkylsulfonyl, aminosulfonyl, $C_1$–$C_{10}$-alkylaminosulfonyl or $C_6$–$C_{10}$-arylaminosulfonyl, $C_1$–$C_{10}$-alkylcarbonyl, ureido, $C_1$–$C_{10}$-alkylcarbonylamino, $C_1$–$C_{10}$-alkoxycarbonyl or aminocarbonyl, where the alkyl or aryl radicals can be substituted by 1 or more of the radicals OH, $NH_2$, $NO_2$, CN, $OCH_3$, $SO_3H$ and COOH;

n is a number from 0 to 3, where, in the case where n is greater than 1, the radicals $R^1$ can also have meanings which differ from one another, as auxiliaries for dyeing or printing fiber materials with fiber-reactive dyestuffs.

5 Claims, No Drawings

USE OF CARBOHYDRATE COMPOUNDS AS AUXILIARIES FOR DYEING AND PRINTING FIBER MATERIALS

DESCRIPTION

Use of carbohydrate compounds as auxiliaries for dyeing and printing fiber materials The technology of dyeing and printing with fiber-reactive dyestuffs on fiber materials uses highly concentrated dyestuff solutions and printing pastes. The solubility of the dyestuffs often presents problems, so that auxiliaries must be used for improving the solubility.

In pad-dyeing processes and textile printing in particular, large quantities of urea are often employed as auxiliary, and this usually passes into the waste water after the application, which is ecologically unacceptable. In cold pad-batch processes and in single-phase printing, for many dyestuffs the stability of alkaline padding liquors and printing pastes leaves something to be desired, which, for example, leads to tailing and thus limits the process reliability and reproducibility of the shades. In the case of ink-jet inks, there is the risk of the ink solution drying up.

The present invention was based on the object of replacing urea, as an auxiliary in the dyeing and printing of textiles, by an ecologically acceptable auxiliary without coloristic disadvantages resulting during dyeing.

Surprisingly, this object has been achieved by using the carbohydrate compounds defined below.

The present invention relates to the use of carbohydrate compounds of the formula (1)

$$Z—G—T—R^1_n \quad (1)$$

in which

Z is the radical of a carbohydrate from the series consisting of mono-, di- and oligosaccharides or of a sugar alcohol, the free valency being on a carbon atom;

G is a bridge member from the series consisting of —O—, —$NR^5$—, —O—CO—, —$NR^5$—CO— and —$NR^5$—$SO_2$—, in which $R^5$ is hydrogen or $C_1$–$C_4$-alkyl, which can be substituted by 1 to 4 radicals from the series consisting of hydroxyl, sulfo, sulfato, di($C_1$–$C_4$-alkyl) amino and carboxyl;

T is a $C_4$–$C_{30}$-aliphatic, cycloaliphatic or olefinic hydrocarbon radical, or is $C_6$–$C_{10}$-aryl, or is $C_6$–$C_{10}$-aryl-$C_1$–$C_4$-alkylene;

$R^1$ is hydroxyl, carboxyl, cyano, $C_1$–$C_4$-alkyl, $C_1$–$C_4$-alkoxy, sulfo, $C_1$–$C_{10}$-alkylsulfonyl, aminosulfonyl, $C_1$–$C_{10}$-alkylaminosulfonyl or $C_6$–$C_{10}$-arylaminosulfonyl, $C_1$–$C_{10}$-alkylcarbonyl, ureido, $C_1$–C10-alkylcarbonylamino, $C_1$–$C_{10}$-alkoxycarbonyl or aminocarbonyl, where the alkyl or aryl radicals can be substituted by 1 or more of the radicals OH, $NH_2$, $NO_2$, CN, $OCH_3$, sulfo and COOH;

n is a number from 0 to 3, where, in the case where n is greater than 1, the radicals $R^1$ can also have meanings which differ from one another, as auxiliaries for dyeing or printing fiber materials with fiber-reactive dyestuffs.

Preferred compounds of the formula (1) in the context of the present invention are those in which Z is the radical of a pentose, a hexose, an oligosaccharide having 2 to 40 monosaccharide units or a sugar alcohol;

G is —O—, —NH—, —$NCH_3$—, —NH—CO—, —$NCH_3$—CO—, —[$N(CH_2CH_2OH)$]—CO—, —O—CO—, —$NHSO_2$— or —$NCH_3$—$SO_2$—;

T is $C_4$–$C_{30}$-alkyl, $C_4$–$C_{30}$-alkenyl, cyclohexyl, phenyl, naphth-1-yl, naphth-2-yl or benzyl;

$R^1$ is hydroxyl, sulfo, carboxyl, methyl, ethyl, methoxy, ethoxy, acetyl, $C_1$–$C_4$-alkylsulfonyl, $C_1$–$C_4$-alkylaminosulfonyl, phenylaminosulfonyl, naphthylaminosulfonyl, $C_1$–$C_4$-alkylcarbonyl, $C_1$–$C_4$-alkylcarbonyl-amino or $C_1$–$C_4$-alkoxycarbonyl; and n is a number from 0 to 1.

Particularly preferred compounds of the formula (1) in the context of the present invention are those in which Z is a radical of the formula (2a), (2b), (2c), (2d), (2e), (2f) or (2g)

(2a)

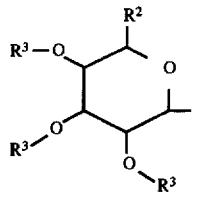

(2b)

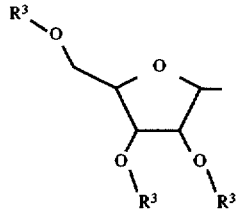

(2c)

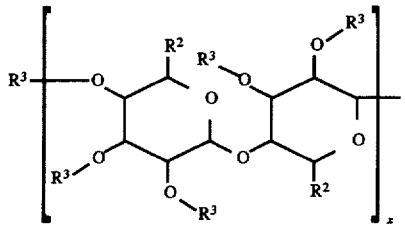

(2d)

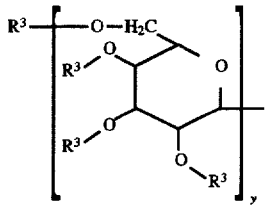

(2e)

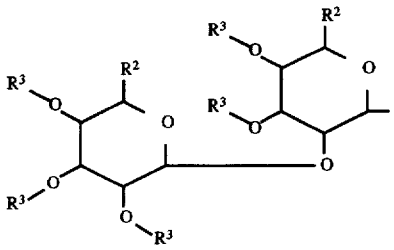

(2f)

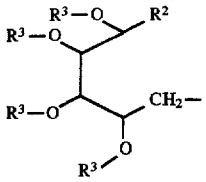

-continued (2g)

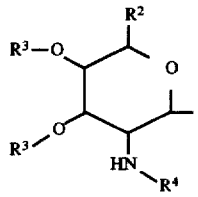

in which x is a number from 1 to 20;

y is a number from 1 to 6, preferably 1 or 2;

R2 is hydroxymethyl, carboxyl, acetyl or $C_1$–$C_4$-alkoxymethyl, in particular methoxymethyl, where the alkoxy radical can be substituted by 1 to 4 substituents from the series consisting of hydroxyl, $C_1$–$C_4$-alkoxy, such as methoxy, acetyl or carboxyl;

$R^3$ is hydrogen, sulfo, acetyl, $C_1$–$C_4$-alkylsulfonyl, such as methylsulfonyl, $C_6$–$C_{10}$-arylsulfonyl, such as phenylsulfonyl, $C_1$–$C_4$-alkyl, which can be substituted by a substituent from the series consisting of hydroxyl and carboxyl, such as, for example, methyl, β-hydroxyethyl or carboxymethyl, or the radical of a glucoside, where the radicals $R^3$ in each case have meanings which are identical or different from one another; and $R^4$ is hydrogen, acetyl, benzoyl or the radical of a peptide or of an amino acid.

$R^2$ is preferably hydroxymethyl, carboxyl, HOOC—$CH_2$—O—$CH_2$— or $H_3C$—O—$CH_2$—. Hydroxymethyl is particularly preferred. $R^3$ is particularly preferably hydrogen, hydroxyethyl, carboxymethyl or sulfo, in particular hydrogen.

$R^4$ is preferably hydrogen.

The linkage of the radical Z of the formulae (2a), (2b), (2c), (2d), (2e) and (2g) to the bridge G can be α- or β-glycosidic in nature, or a mixture of the two forms can be present.

The stereochemistry of the sugar radical of the formulae (2a), (2b), (2c), (2d), (2e) and (2g) can be D, L or DL, but preferably D. In the case where Z is (2c) or (2e), the linkage of the one saccharide monomer unit to the second saccharide unit can be α- or β-glycosidic in nature, or a mixture of the two forms can be present, the β-glycosidic linkage being preferred. The linkage of the recurring disaccharide units can likewise be α- or β-glycosidic in nature, or a mixture of the two forms can be present, here also the β-glycosidic linkage being preferred.

In the case where G is —O— or —$NR^5$—, the radical Z is preferably a radical of the formula (2a), (2b), (2c) (2d), (2e) or (2g), in particular (2a). In the case where G is —$NR^5$—CO—, —$NR_5$—$SO_2$— or —O—CO—, the radical Z is preferably a radical of the formula (2f).

In the case where Z is (2e), the radical T is preferably a $C_{12}$–$C_{20}$-alkyl radical, which can contain 1 to 10 olefinic double bonds, and $R^1$ is preferably hydroxyl or carboxyl.

The carbohydrate radical of the formula (2a) is preferably the radical of a D-glucopyranoside, D-mannopyranoside or D-galactopyranoside, in particular the radical of a D-glucopyranoside.

The carbohydrate radical of the formula (2b) is preferably the radical of a D-ribofuranoside, D-fructofuranoside or D-glucofuranoside.

The carbohydrate radical of the formula (2c) is preferably a cellobiose, maltose, lactose or poly- or oligo-β-1,4-D-glucose or -α-1,4-D-glucose radical.

The monomer member of the carbohydrate radical of the formula (2d) is preferably an α-1,6-D-glucose or β-1,6-D-glucose radical.

The carbohydrate radical of the formula (2e) is preferably the radical of a sophorose.

The carbohydrate radical of the formula (2f) is preferably sorbitol or mannitol.

The carbohydrate radical of the formula (2g) is preferably a D-glucosamine, and, together with G, particularly preferably forms the radical of a glucamide, if G is —$NR^5$—CO—.

Furthermore, Z can be the radical of a trisaccharide of the raffinose type.

Examples of preferred structural elements T-$[R^1]_n$ are the radicals 3-hydroxyphenyl, 4-hydroxyphenyl, 2-hydroxyphenyl, 2-carboxyphenyl, naphth-2-yl, 6-carboxy-naphth-2-yl, 3-carboxy-naphth-2-yl, 4-carboxyphenyl, 1-carboxy-naphth-2-yl, 5-hydroxy-naphth-2-yl, 8-hydroxy-naphth-2-yl, 3-hydroxy-naphth-2-yl, 6-hydroxy-naphth-2-yl, 7-hydroxy-naphth-2-yl, 6-sulfo-naphth-2-yl, 8-sulfo-naphth-2-yl, 3-hydroxy-6-sulfo-naphth-2-yl, 8-hydroxy-6-sulfo-naphth-2-yl, 6-aminosulfonyl-naphth-2-yl, 7-(2'-hydroxyphenyl)-aminosulfonyl-naphth-2-yl, naphth-1-yl, butyl, n-pentyl, n-hexyl, n-heptyl, n-octyl, n-nonyl, n-decyl, n-$C_{12}$ to $C_{16}$-alkyl and n-$C_{12}$ to $C_{16}$-alkenyl.

Examples of sugar radicals Z are ribose, arabinose, xylose, glucose, mannose, galactose, fructose, glucuronic acid or mannuronic acid.

Examples of particularly preferred carbohydrate compounds of the formula (1) are the compounds of the formulae (1a) to (1k)

(1a)

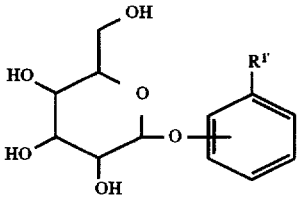

(1b)

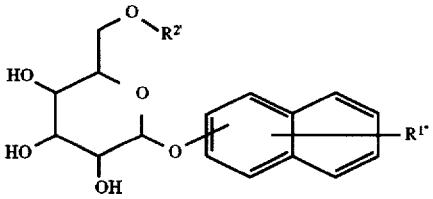

(1c)

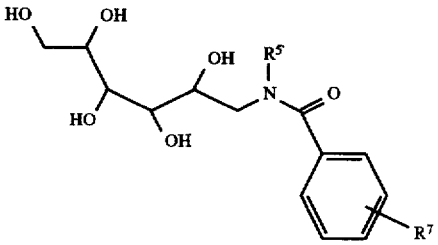

(1d)

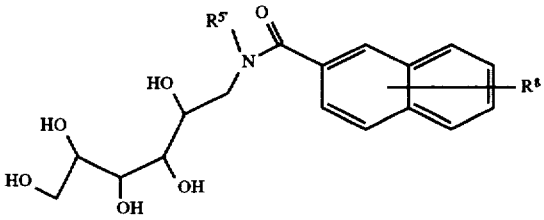

-continued (1e)

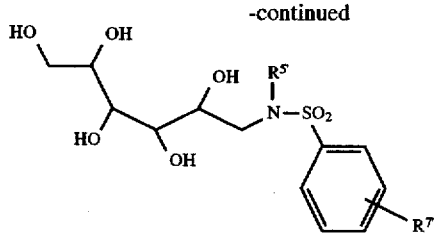

(1f)

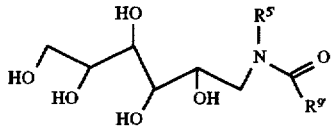

(1g)

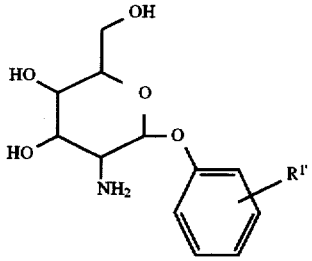

(1h)

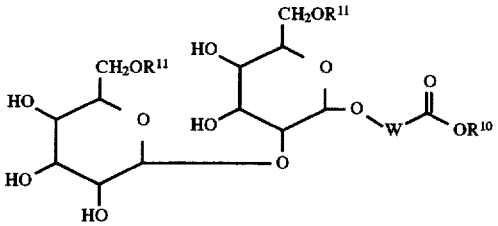

(1i)

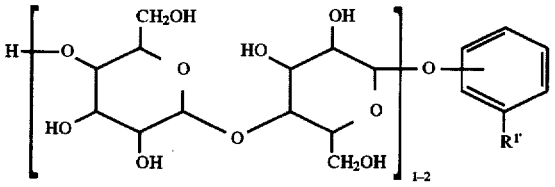

(1j)

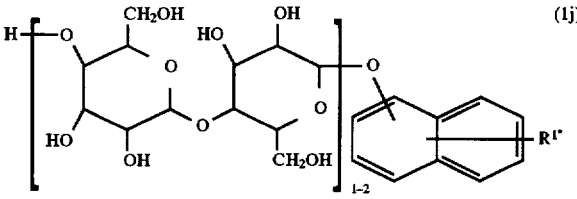

(1k)

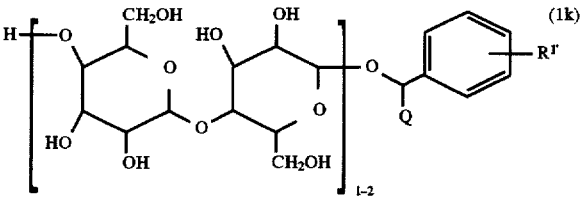

in which $R^{1'}$ is hydrogen, hydroxyl, carboxyl, $COOCH_3$ or $COOC2H_5$;

$R^{2'}$ is hydrogen, acetyl or carboxymethyl;

$R^{1''}$ is hydrogen, hydroxyl, sulfo or carboxyl, where $R^{1''}$ and the pyranosyl radical are preferably in the 2,3- or 2,6-position relative to one another;

$R^{5'}$ is hydrogen or methyl;

$R^{7}$ is hydroxyl or hydrogen;

$R^{7'}$ is hydroxyl, methyl or hydrogen, and is preferably in the ortho- or para-position relative to the sulfonyl group;

$R^{8}$ is hydroxyl or hydrogen, where $R^{8}$ and the saccharylaminocarbonyl radical are preferably in the 2,3- or 2,6-position relative to one another;

$R^{9'}$ is $C_7$–$C_{20}$-alkyl, preferably $C_{11}$–$C_{17}$-alkyl, which can contain 1 to 3 olefinic double bonds;

W is $C_{13}$–$C_{19}$-alkylene, preferably $C_{17}$-alkylene, which can contain 1 to 8 olefinic double bonds and/or can be branched;

$R^{10}$ is hydrogen or methyl;

$R^{11}$ is hydrogen or acetyl; and

Q is hydrogen, cyano or carboxyl.

Examples of particularly suitable carbohydrate compounds of the formula (1) are 2-hydroxyphenyl α-D-galactopyranoside, 2-hydroxyphenyl α-D-glucopyranoside, 2-hydroxyphenyl β-D-glucopyranoside, 2-hydroxyphenyl β-D-galactopyranoside, 2-carboxyphenyl α-D-galactopyranoside, 2-carboxyphenyl α-D-glucopyranoside, 2-carboxyphenyl β-D-glucopyranoside, 2-carboxyphenyl β-D-galactopyranoside, 4-hydroxyphenyl α-D-galactopyranoside, 4-hydroxyphenyl α-D-glucopyranoside, 4-hydroxyphenyl β-D-glucopyranoside, 4-hydroxyphenyl β-D-galactopyranoside, 3-hydroxyphenyl α-D-galactopyranoside, 3-hydroxyphenyl α-D-glucopyranoside, 3-hydroxyphenyl β-D-glucopyranoside, 3-hydroxyphenyl β-D-galactopyranoside, 3,5-dihydroxyphenyl α-D-galactopyranoside, 3,5-dihydroxyphenyl α-D-glucopyranoside, 3, 5-dihydroxyphenyl β-D-glucopyranoside, 3,5-dihydroxyphenyl β-D-galactopyranoside, naphth-2-yl α-D-galactopyranoside, naphth-2-yl α-D-glucopyranoside, naphth-2-yl β-D-glucopyranoside, naphth-2-yl β-D-galactopyranoside, 6'-carboxymethyl-naphth-2-yl α-D-galactopyranoside, 6'-carboxymethyl-naphth-2-yl α-D-glucopyranoside, 6'-carboxymethyl-naphth-2-yl β-D-glucopyranoside, 6'-carboxymethyl-naphth-2-yl β-D-galactopyranoside, naphth-1-yl α-D-galactopyranoside, naphth-1-yl α-D-glucopyranoside, naphth-1-yl β-D-glucopyranoside, naphth-1-yl β-D-galactopyranoside, 3-carboxy-naphth-2-yl α-D-galactopyranoside, 3-carboxy-naphth-2-yl α-D-glucopyranoside, 3-carboxy-naphth-2-yl β-D-glucopyranoside, 3-carboxy-naphth-2-yl β-D-galactopyranoside, 6-carboxy-naphth-2-yl α-D-galactopyranoside, 6-carboxy-naphth-2-yl α-D-glucopyranoside, 6-carboxy-naphth-2-yl β-D-glucopyranoside, 6-carboxy-naphth-2-yl β-D-galactopyranoside, 1-carboxy-naphth-2-yl β-D-glucopyranoside, 1-hydroxy-naphth-2-yl β-D-glucopyranoside, 3-hydroxy-naphth-2-yl β-D-glucopyranoside, 6-hydroxy-naphth-2-yl β-D-glucopyranoside, 7-hydroxy-naphth-2-yl β-D-glucopyranoside, 6-aminosulfonyl-naphth-2-yl β-D-glucopyranoside, 7-(2'-carboxyphenyl)-aminosulfonyl-naphth-2-yl β-D-glucopyranoside, 8-sulfo-naphth-2-yl β-D-glucopyranoside, 6-sulfo-naphth-2-yl β-D-glucopyranoside, 8-hydroxy-6-sulfo-naphth-2-yl β-D-glucopyranoside, N-methyl-N-(D-gluco-2,3,4,5,6-pentahydroxyhexyl)-salicylamide, N-(D-gluco-2,3,4,5,6-pentahydroxyhexyl)-salicylamide, 3-{N-methyl-N-(D-gluco-2,3,4,5,6-pentahydroxyhexyl)}-aminocarbonyl-2-naphthol, 3-{N-(D-gluco-2,3,4,5,6-pentahydroxyhexyl)}-aminocarbonyl-2-naphthol, 6-{N-Methyl-N-(D-gluco-2,3,4,5,6-pentahydroxyhexyl)}-aminocarbonyl-2-naphthol, 6-{N-(D-gluco-2,3,4,5,6-pentahydroxyhexyl)}-aminocarbonyl-2-naphthol, N-methyl-N-(D-gluco-2,3,4,5,6-pentahydroxyhexyl)-stearamide, N-(D-gluco-2,3,4,5,6-pentahydroxyhexyl)-stearamide, N-methyl-N-(D-gluco-2,3, 4,5,6-pentahydroxyhexyl)-oleamide, N-(D-gluco-2,3,4,5,6-pentahydroxyhexyl)-oleamide, N-methyl-N-(D-gluco-2,3,4,5,6-pentahydroxyhexyl)-palmitamide, N-(D-gluco-2,3,4,5,6-pentahydroxyhexyl)-palmitamide, N-methyl-N-(D-gluco-2,3,4,5,6-pentahydroxyhexyl)-benzamide, N-(D-gluco-2,3,4,5,6-pentahydroxyhexyl)-benzamide, 2'-methoxy-N-methyl-N-(D-gluco-2,3,4,5,6-pentahydroxyhexyl)-benzamide, 2'-methoxy-N-(D-gluco-2,3,4,5,6-pentahydroxyhexyl)-benzamide, 4'-hydroxy-N-methyl-N-(D-gluco-2,3,4,5,6-pentahydroxyhexyl)-benzamide, 4'-hydroxy-N-(D-gluco-2,3,4,5,6-pentahydroxyhexyl)-benzamide, phenylsulfonyl-N-methyl-N-(D-gluco-2,3,4,5,6-pentahydroxyhexyl)-amide, phenylsulfonyl-N-(D-gluco-2,3,4,5,6-pentahydroxyhexyl)-amide, 3-{N-methyl-N-(D-gluco-2,3,4,5,6-pentahydroxyhexyl)}-aminosulfonyl-2-naphthol, 3-{N-(D-gluco-2,3,4,5,6-pentahydroxyhexyl)}-aminosulfonyl-2-naphthol, 6-{N-methyl-N-(D-gluco-2,3,4,5,6-pentahydroxyhexyl)}-aminosulfonyl-2-naphthol, 6-{N-(D-gluco-2,3,4,5,6-pentahydroxyhexyl)}-aminosulfonyl-2-naphthol, {4'-methyl-phenyl}-sulfonyl-N-methyl-N-(D-gluco-2,3,4,5,6-pentahydroxyhexyl)-amide, {4'-methyl-phenyl}-sulfonyl-N-(D-gluco-2,3,4,5,6-pentahydroxyhexyl)-amide, {2'-methyl-phenyl}-sulfonyl-N-methyl-N-(D-gluco-2,3,4,5,6-pentahydroxyhexyl)-amide, {2'-methyl-phenyl}-sulfonyl-N-(D-gluco-2,3,4,5,6-pentahydroxyhexyl)-amide, and sophorose lipids and sophorose lipid mixtures, such as, for example

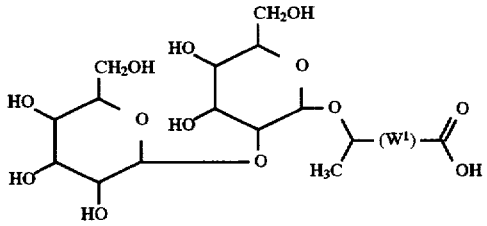

in which $W^1$ is a radical of the formulae $—(CH_2)_{13}—$, $—(CH_2)_{15}—$, $—(CH_2)_6—CH=CH—(CH_2)_7—$ or $—(CH2)_3—CH=CH—CH_2—CH=CH—(CH_2)_7$ — or a combination thereof.

The compounds of the formula (1) and their preparation are known, for example from Pol. J. Chem. (1993), 67(7), 1251; Liebigs Ann. Chemie (1992), 5, 485; Tetrahedron Letters (1979), 52, 5051; Carbohydr. Res. (1977), 53, C11; Acta Chem Scand., Ser. B. (1978), B 32, 72; J. Carbohydr. Chem. (1992), 11(6), 761; DE-A-4329093; Stanek, Cerny: "The Monosaccharides", Academic Press, Prague 1963.

Suitable dyestuffs in the context of the present invention are fiber-reactive dyestuffs from the series consisting of monoazo, bisazo, polyazo, metal complex azo, anthraquinone and metal complex formazan dyestuffs, such as Cu formazans, metal complex phthalocyanine dyestuffs, such as Cu or Ni phthalocyanine dyestuffs, and triphendioxazine dyestuffs, such as are known, for example, from numerous patent specifications, books or publications (for example Venkataraman, K.: The Chemistry of Synthetic Dyes, Volume VI.).

Of the monoazo dyestuffs, the structural elements listed below are particularly suitable for the application technique described:

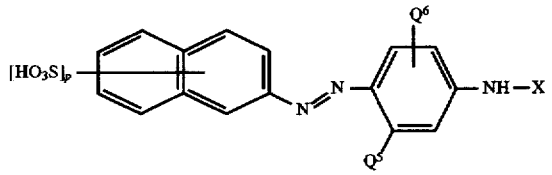

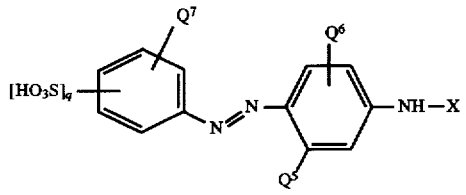

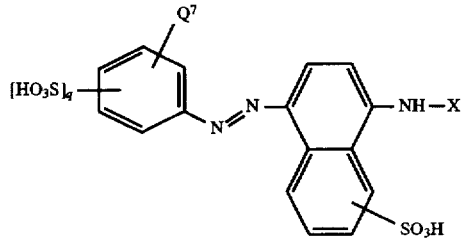

-continued
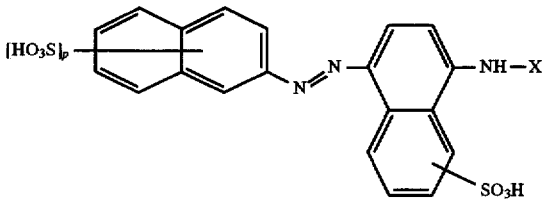
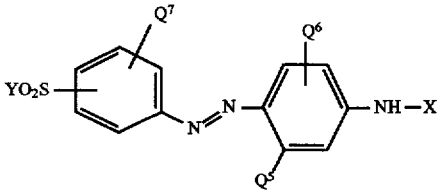
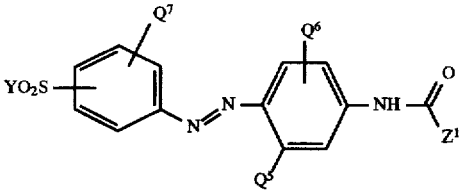
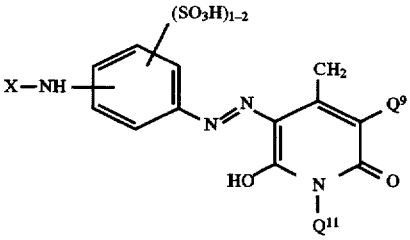
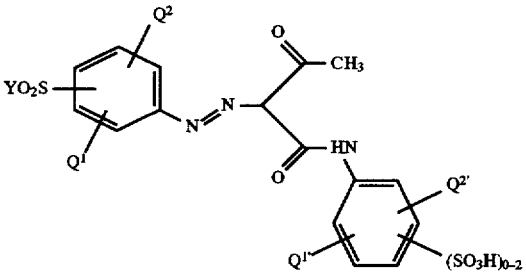
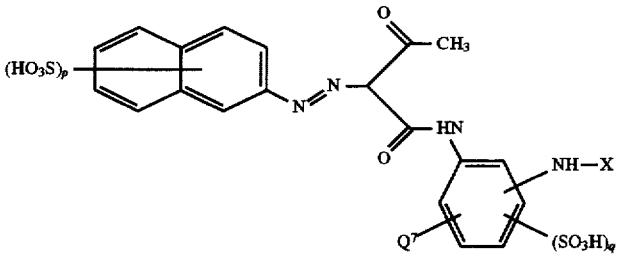
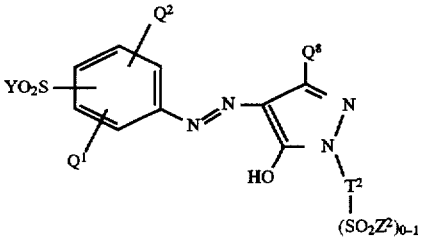

-continued
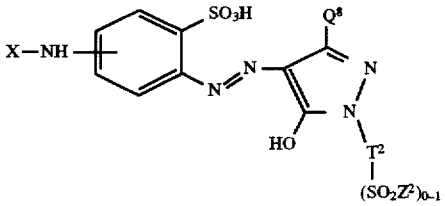
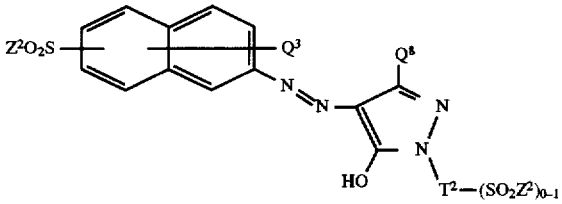
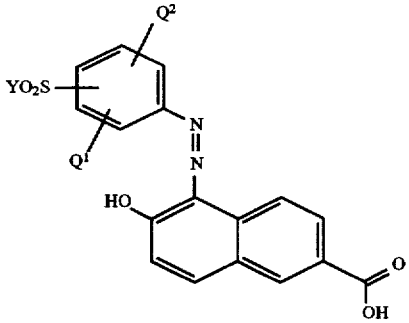
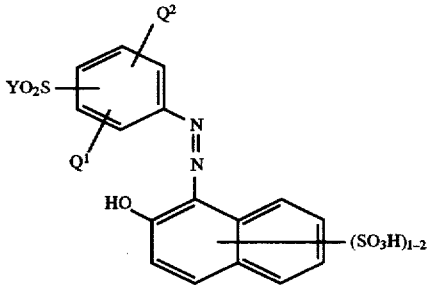
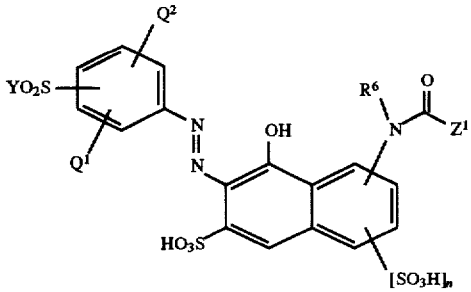
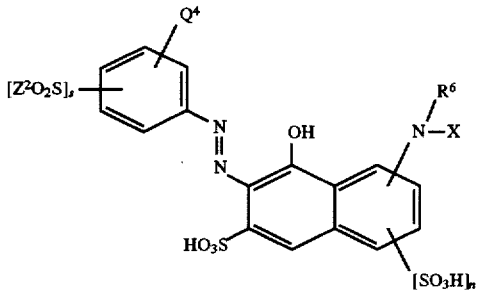

-continued
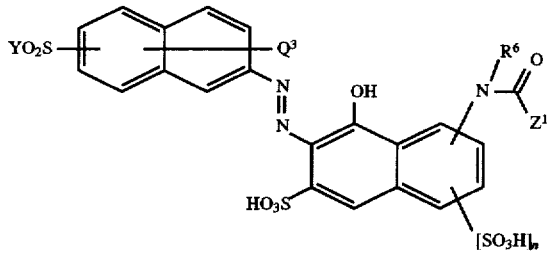
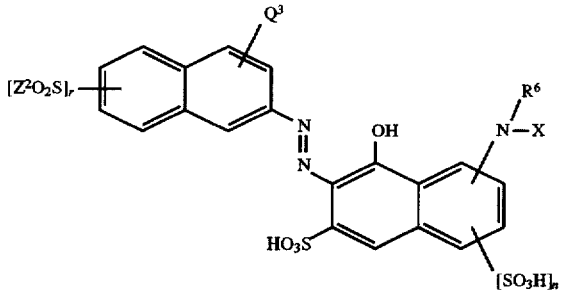
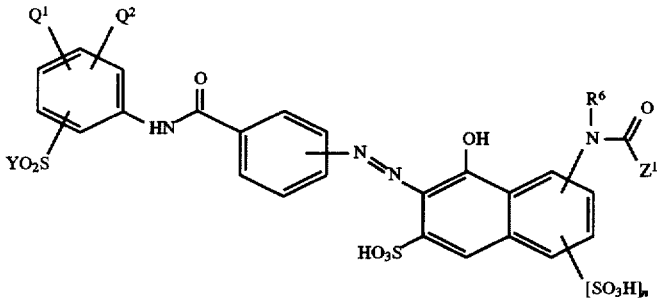
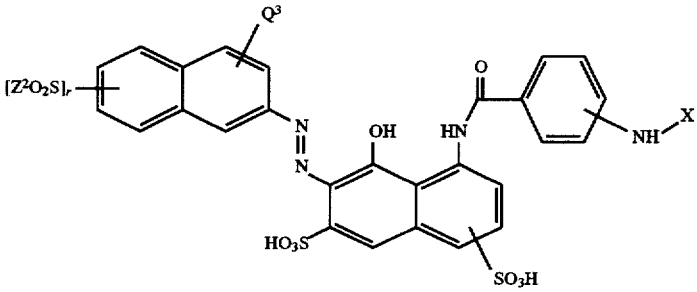
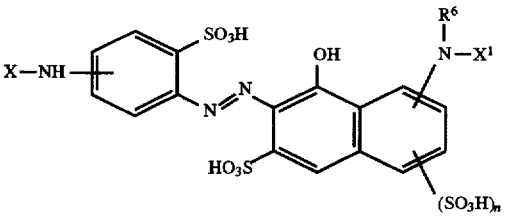

-continued
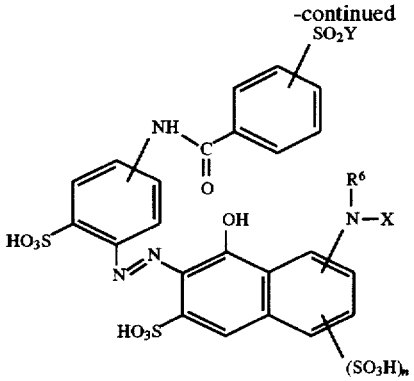
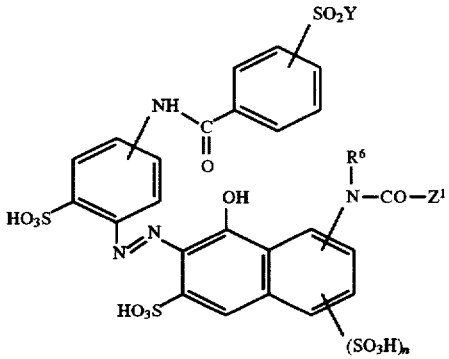
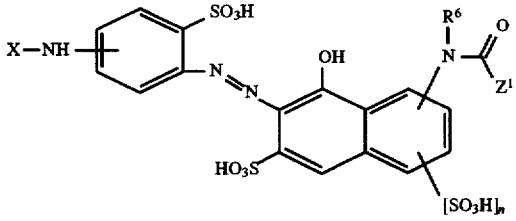
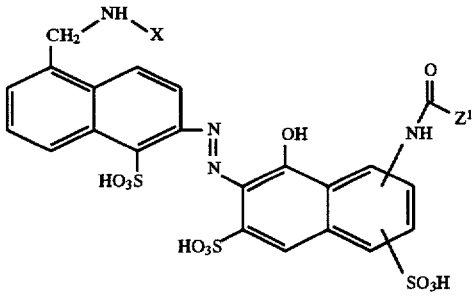
Of the bisazo dyestuffs, the compounds listed below are particularly suitable for the application technique described:
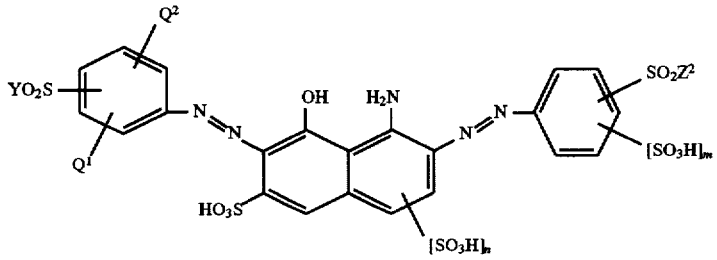

-continued
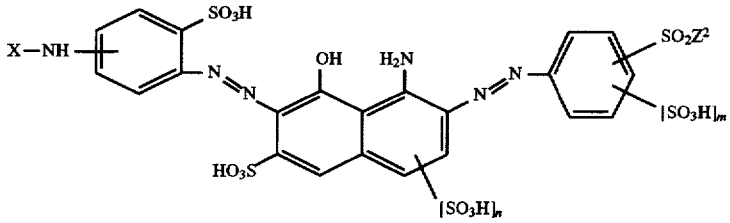
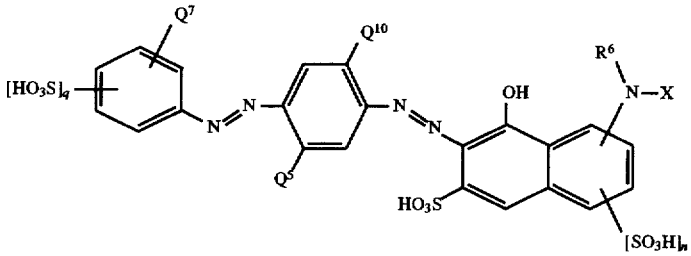
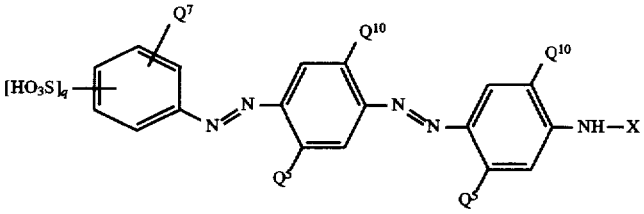
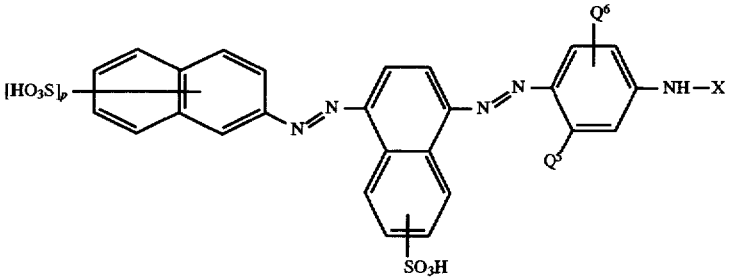
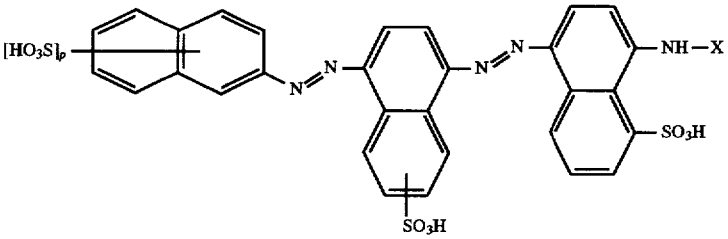
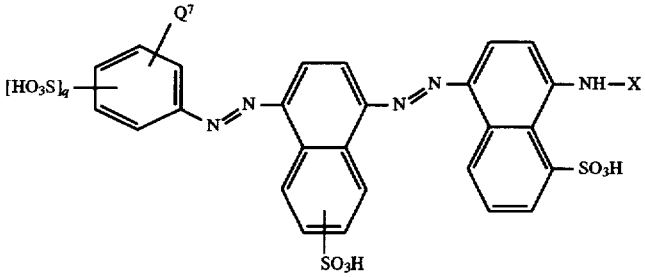

-continued

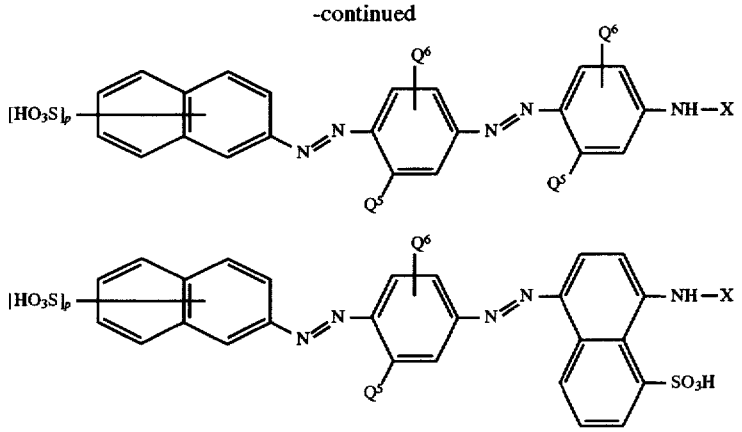

Of the anthraquinone dyestuffs, the compounds listed below are particularly suitable for the application technique described:

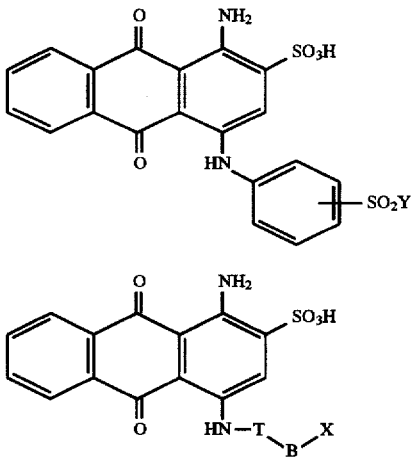

Of the Cu formazan dyestuffs, the compounds listed below are particularly suitable for the application technique described:

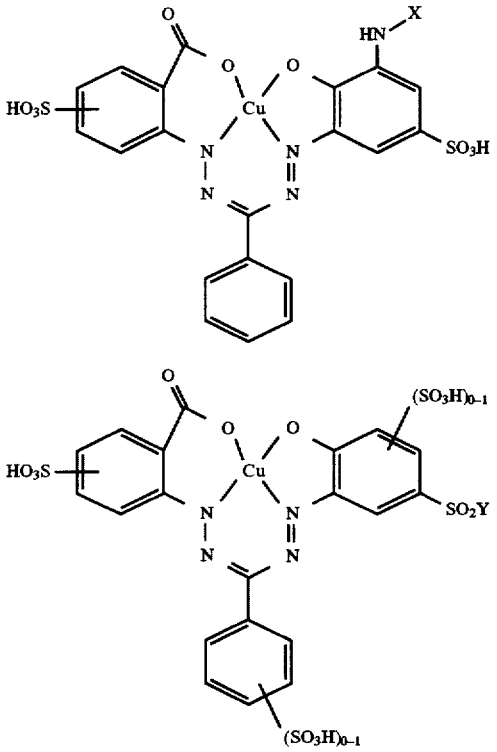

Of the triphendioxazine dyestuffs, the compounds listed below are particularly suitable for the application technique described:

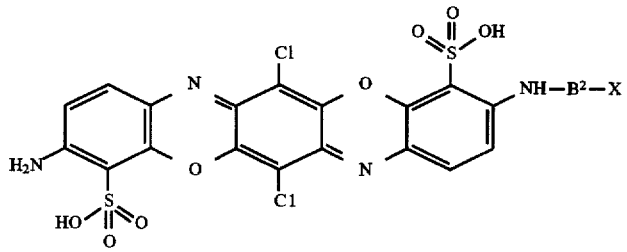

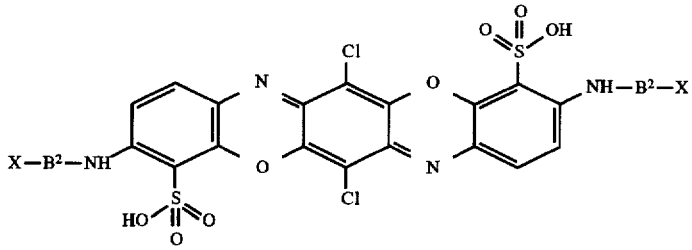

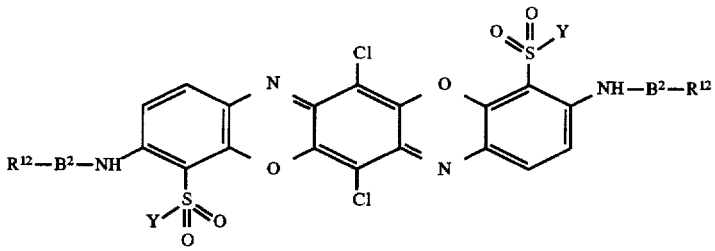

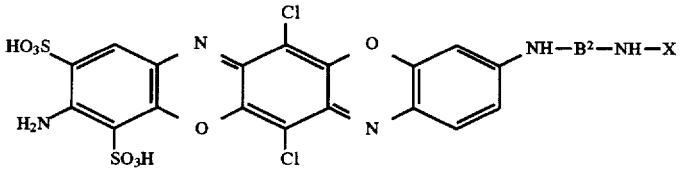

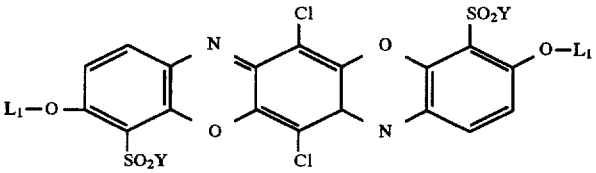

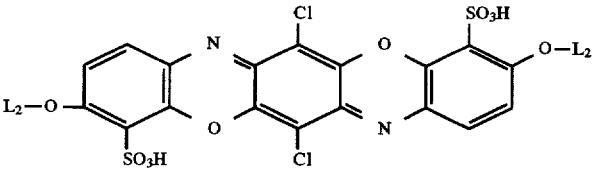

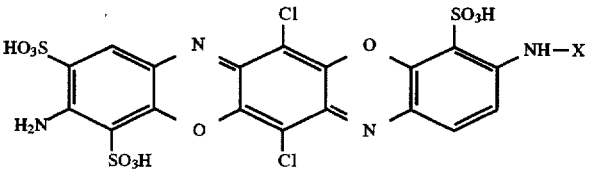

in which $L_1$ is $C_1$–$C_6$-alkylene-NH—Z, $C_1$–$C_6$-alkylene-$SO_2Y$, $C_1$–$C_6$-alkylene-NH—$C_1$–$C_6$-alkylene-$SO_2Y$ or $C_1$–$C_6$-alkylene-O—$C_1$–$C_6$-alkylene-$SO_2Y$ and $L_2$ is $C_1$–$C_6$-alkylene-$OSO_3H$, $C_1$–$C_6$-alkyene-COOH or $C_1$–$C_6$-alkylene-$SO_3H$.

Particularly preferred alkylene radicals are ethylene and propylene.

Of the phthalocyanine dyestuffs, the compounds listed below are particularly suitable for the application technique described:

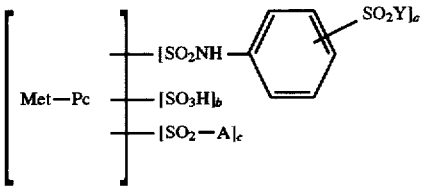

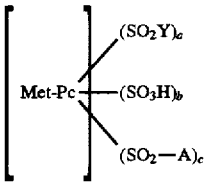

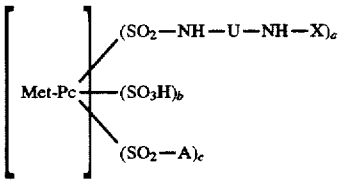

The variables in the formulae given above have the following meanings:

Y is vinyl, or is an ethyl which is substituted in the β-position by a substituent which can be eliminated under alkaline conditions;

$R^6$ is hydrogen or methyl, preferably hydrogen;

$Q^1$ is methoxy, methyl or hydrogen, preferably hydrogen;

$Q^2$ is hydrogen, hydroxyl, methoxy, carboxyl, sulfo or halogen, preferably hydrogen, or O—Cu, where, in this case, the azo bridge and the hydroxyl group of the coupling component likewise complex with Cu;

$Q^1$ has one of the meanings of $Q^1$;

$Q^2$ has one of the meanings of $Q^2$;

$Q^3$ is hydrogen or sulfo;

$Q^4$ is hydrogen, hydroxyl, methoxy, methyl, carboxyl or sulfo, preferably hydrogen;

$Q^5$ is methyl, methoxy, amino, ureido or acetylamino;

$Q^6$ is hydrogen, sulfo, methyl or methoxy;

$Q^7$ is hydrogen, methyl or methoxy;

$Q^8$ is methyl or carboxyl;

$Q^9$ is hydrogen, cyano, aminocarbonyl or sulfomethyl;

$Q^{10}$ is hydrogen, methyl, methoxy, hydroxyl or O—Cu, where, in this case, the azo bridge and the hydroxyl group of the coupling component likewise complex with Cu;

$Q^{11}$ is methyl, ethyl or β-sulfoethyl;

$T^2$ is phenylene or naphthylene, preferably 1,4-phenylene, which can be substituted by 1 to 3 identical or different substituents from the series consisting of chlorine, methyl, sulfo and carboxyl;

$Z^1$ is methyl, ethyl or phenyl;

$Z^2$ is hydroxyl or has the same meaning as Y;

n is 0 or 1;

m is 0 or 1, preferably 0;

r is 0 or 1, preferably 1;

s is 0 or 1, preferably 1;

p is 1 to 3;

q is 1 or 2;

T is phenylene, which can be substituted by 1 to 3 methyl groups and 1 or 2 sulfo groups, a total of 3 substituents being possible;

B is a bridge member —S—, —O— or —NH—;

$B^2$ is a direct bond or a bridge member from the series consisting of $—(CH_2)_2—NH—$, $—(CH_2)_3—NH—$, $—(CH_2)_2—O—$, $—(CH_2)_3—O—$ and aminophenylene, where the phenyl radical is preferably substituted by a sulfo group;

$R^{12}$ is sulfo or the radical of an optionally substituted $C_1$-$C_4$-alkylcarbonyl compound, preferably β-carboxyethyl-carbonyl;

Met is a metal atom, preferably Cu or Ni;

Pc is the radical of a phthalocyanine;

A is amino or

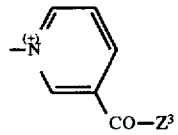

in which $Z^3$ is OH or $NH_2$;

a is a whole or fractional number from 0.5 to 2.5, preferably 1.0 to 1.9;

b is a whole or fractional number from 0 to 4, preferably 1.5 to 2.5;

c is a whole or fractional number from 0 to 2, preferably 0 to 1, where the sum a+b+c is a number between 3 and 4.5, preferably 3.1 and 3.7;

X is a heterocyclic fiber-reactive radical, preferably from the series consisting of quinoxalines, triazines and pyrimidines, preferably a pyrimidine of the formula

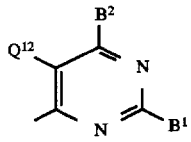

in which $B^1$ is $—SO_2CH_3$, Cl or F; $B^2$ is $CH_3$, Cl or F and at least one of the radicals $B^1$ and $B^1$ and $B^2$ is F or Cl; and $Q^{12}$ is hydrogen, chlorine, fluorine or cyano;

or preferably a triazine of the formulae

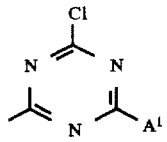

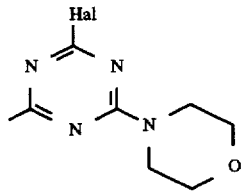

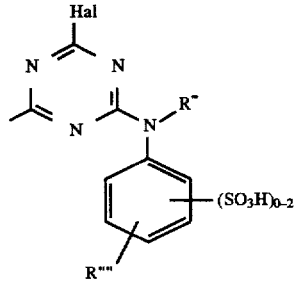

-continued

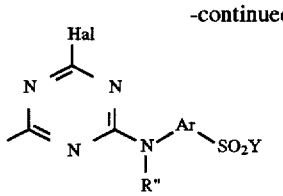

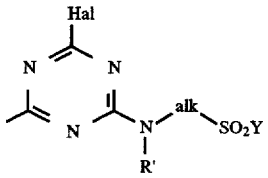

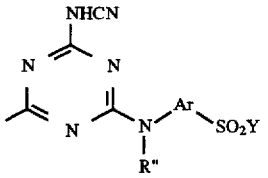

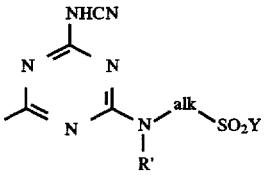

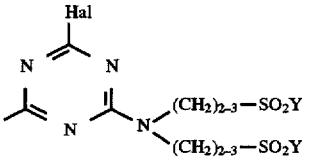

in which

Y has one of the abovementioned meanings and

Hal is chlorine or fluorine;

$A^1$ is amino or chlorine;

alk is 1,2-ethylene, 1,3-propylene or $—(CH_2)_2—O—(CH_2)_2—$;

Ar is 1,3- or 1,4-phenylene, which can be substituted by methoxy;

R' is hydrogen, methyl, ethyl or phenyl;

R" is hydrogen, methyl or ethyl, preferably hydrogen;

R'" is hydrogen, methyl or ethyl, preferably hydrogen; and

R"" is hydrogen, chlorine or methyl, preferably hydrogen;

or X is a radical of the formula

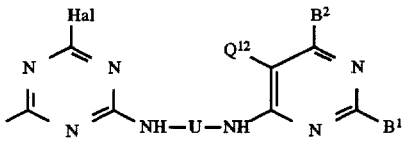

in which Hal, Q , $B^1$ and $B^2$ are defined as above and

U $C_1$–$C_6$-alkylene; $C_6$-arylene, which can be substituted by 1 or 2 of the radicals sulfo, carboxyl, methyl and/or methoxy, $—(C_6–C_{10})$aryl-$(C_1–C_6)$-alkylene,

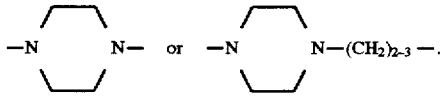

Particularly preferred pyrimidine compounds are:

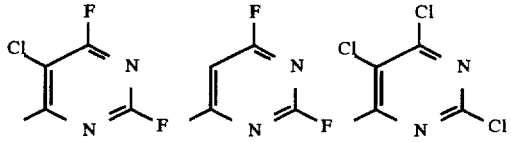

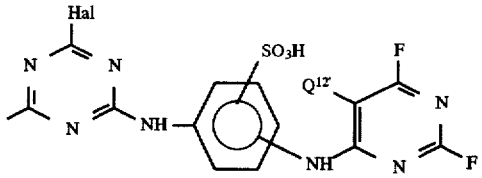

in which $Q^{12'}$ is hydrogen or chlorine.

$X^1$ has one of the meanings of X and is preferably a triazine radical or a radical of the formula

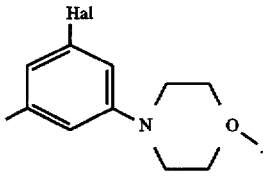

Examples of particularly suitable fiber-reactive dyestuffs are 7-(4'-β-sulfatoethylsulfonyl)-phenylazo-8-hydroxy-2-acetylamino-6-sulfo-naphthalene, 7-(4'-β-sulfatoethylsulfonyl)-phenylazo-8-hydroxy-3-acetylamino-6-sulfo-naphthalene, 7-(4'-β-sulfatoethylsulfonyl)-phenylazo-8-hydroxy-1-acetylamino-3,6-disulfo-naphthalene, 7-(4'-β-sulfatoethylsulfonyl)-phenylazo-8-hydroxy-1-acetylamino-4,6-disulfo-naphthalene, 7-(4'-β-sulfatoethylsulfonyl)-phenylazo-8-hydroxy-2-benzoylamino-6-sulfo-naphthalene, 7-(4'-β-sulfatoethylsulfonyl)-phenylazo-8-hydroxy-3-benzoylamino-6-sulfo-naphthalene, 7-(4'-β-sulfatoethylsulfonyl)-phenylazo-8-hydroxy-1-benzoylamino-3,6-disulfo-naphthalene, 7-(4'-β-sulfatoethylsulfonyl)-phenylazo-8-hydroxy-1-benzoylamino-4,6-disulfo-naphthalene, 7-[6'-β-sulfatoethylsulfonyl-1-sulfo-naphth-2'-yl]azo-8-hydroxy-1-acetylamino-3, 6-disulfo-naphthalene, 7-[6'-β-sulfatoethylsulfonyl-naphth-2'-yl]azo-8-hydroxy-3-acetylamino-6-sulfo-naphthalene, 7-[8'-β-sulfatoethylsulfonyl-6'-sulfo-naphth-2'-yl]azo-8-hydroxy-3-acetylamino-6-sulfo-naphthalene, 7-[8'-β-sulfatoethylsulfonyl-naphth-2'-yl]azo-8-hydroxy-3-acetylamino-6-sulfo-naphthalene;

2,7-bis-[(4'-β-sulfatoethylsulfonyl)-phenylazo]-8-hydroxy-1-amino-3,6-disulfo-naphthalene, 2,7-bis-[(4'-β-sulfatoethylsulfonyl)-phenylazo]-8-hydroxy-1-amino-4,6-disulfo-naphthalene, 2-(4'-β-sulfatoethylsulfonyl)-phenylazo-7-(4"-sulfophenylazo)-8-hydroxy-1-amino-3, 6-disulfo-naphthalene, 2-(4'-β-sulfatoethylsulonyl)-phenylazo-7-(2",5"-disufophenylazo)-8-hydroxy-1-amino-3,6-disulfo-naphthalene, 2-(4'-β-sulfatoethylsulfonyl)-phenylazo-7-(4"-β-sulfatoethylsulfonyl-2", 5"-dimethoxy-phenyl-azo)-8-hydroxy-1-amino-3,6-disulfo-naphthalene, 2-(4'-β-sulfatoethylsulfonyl)-phenylazo-7-(4"-β-sulfatoethylsulfonyl-2"-methoxy-5"-methyl-phenyl-azo)-8-hydroxy-1-amino-3,6-disulfo-naphthalene, 2-(4'-β-sulfatoethylsulfonyl)-phenylazo-7-{5"-(5"'-chloro-2"',4"'-difluoro-pyrimidine-6"'-yl)-amino-2"-sulfo-phenyl-azo}-8-hydroxy-1-amino-3,6-disulfo-naphthalene, 2-(4'-β-sulfatoethylsulfonyl)-phenylazo-7-{5"-(2"'-chloro-4"'-amino-triazin-6"'-yl)-amino-2'-sulfo-phenyl-azo}-8-hydroxy-1-amino-3,6-disulfo-naphthalene;

7-[1',5"-disulfo-naphth-2'-yl]azo-8-hydroxy-3-{5"-chloro-2", 4"-difluoro-pyrimidin-6"-yl}-amino-6-sulfo-naphthalene, 7-[4',8"-disulfo-naphth-2'-yl]azo-8-hydroxy-3-{5"-chloro-2",4"-difluoro-pyrimidin-6"-yl}-amino-6-sulfo-naphthalene, 7-[1'-sulfo4'-methoxy-phenyl]azo-8-hydroxy-3-{5"-chloro-2",4"-difluoro-pyrimidin-6"-yl}-amino-6-sulfo-naphthalene, 7-[1'-sulfo-4'-methyl-phenyl]azo-8-hydroxy-3-{5"-chloro-2",4"-difluoro-pyrimidin-6"-yl}-amino-6-sulfo-naphthalene, 7-[1'-sulfo-4'-methoxy-phenyl]azo-8-hydroxy-3-{2", 4",5"-trichloro-pyrimidin-6"-yl}-amino-6-sulfo-naphthalene, 7-[1'-sulfo-4'-methoxy-phenyl]azo-8-hydroxy-3-{2", 4"-difluoro-pyrimid in-6"-yl}-amino-6-sulfo-naphthalene, 7-[1',5"-disulfo-naphth-2'-yl]azo-8-hydroxy-3-{2"-chloro-4"-amino-triazin-6"-yl}-amino-6-sulfo-naphthalene, 7-[4',8"-disulfo-naphth-2'-yl]azo-8-hydroxy-3-{2"-chloro-4"-amino-triazin-6"-yl}-amino-6-sulfo-naphthalene, 7-[1'-sulfo-4'-methoxy-phenyl]azo-8-hydroxy-3-{2"-chloro-4"-amino-triazin-6-yl}-amino-6-sulfo-naphthalene, 7-[1'-sulfo-4'-methyl-phenyl]azo-8-hydroxy-3-{2"-chloro-4"-amino-triazin-6"-yl}-amino-6-sulfo-naphthalene;

7-[1'-sulfo-4'-methoxy-phenyl]azo-8-hydroxy-3-{2"-fluoro-4"-morpholino-triazin-6"-yl}-amino-6-sulfo-naphthalene, 7-[1'-sulfo-4'-methoxy-phenyl]azo-8-hydroxy-3-{2"-fluoro-4"-phenylamino-triazin-6"-yl}-amino-6-sulfo-naphthalene, 7-[1'-sulfo-4'-methoxy-phenyl]azo-8-hydroxy-3-{2"-fluoro-4"-(2"'-methyl-phenyl)amino-triazin-6"-yl}-amino-6-sulfo-naphthalene, 7-[1'-sulfo-4'-methoxy-phenyl]azo-8-hydroxy-3-{2"-fluoro-4"-(N-ethyl-phenyl)-amino- trazin-6"-yl}-amino-6-sulfo-naphthalene, 7-[1'-sulfo-4'-methoxy-phenyl]azo-8-hydroxy-3-{2"-fluoro-4"-(N-methyl-phenyl)-amino-triazin-6"-yl}-amino-6-sulfo-naphthalene, 7-[1'-sulfo-4'-methoxy-phenyl]azo-8-hydroxy-3-{2"-fluoro-4"-(3"'-β-sulfatoethylsulfonyl-propyl)-amino-triazin-6"-yl}-amino-6-sulfo-naphthalene, 7-[1'-sulfo-4'-methoxy-phenyl]azo-8-hydroxy-3-{2"-fluoro-4"-(N-phenyl-3"'-β-sulfatoethyl-sulfonyl-propyl)-amino-triazin-6"-yl}-amino-6-sulfo-naphthalene, 7-[1'-sulfo-4'-methoxy-phenyl]azo-8-hydroxy-3-{2"-fluoro-4"-(N-phenyl-2"'-βsulfatoethyl-sulfonyl-ethyl)-amino-triazin-6"-yl}-amino-6-sulfo-naphthalene;

1-amino-2-sulfo-4-(3'-β-sulfatoethylsulfonyl)-phenylamino-anthraquinone, 1-amino-2-sulfo-4-(3'-vinylsulfonyl)-phenylamino-anthraquinone, 1-amino-2-sulfo-4-(4'-β-sulfatoethylsulfonyl)-phenylamino-anthraquinone, 1-amino-2-sulfo-4-(4'-vinylsulfonyl)-phenylamino-anthraquinone;

3,10-bis-{2'-[(β-carboxyethyl)carbonyl-amino]-ethyl-amino}-9,13-dichloro-4, 11-bis(β-sulfato-ethylsulfonyl)-triphendioxazine, 3,10-bis-{β-sulfatoethyl-amino}-9,13-dichloro-4, 11-bis(β-sulfato-ethylsulfonyl)-triphendioxazine, 3,10-bis-{3'-[2"-fluoro-4"-(2"',5"'-disulfophenyl)amino-triazin-6"-yl]-amino-propyl-amino}-9,13-dichloro-4,11-disulfo-triphendioxazine, 3,10-bis-{2'-[2"-chloro-4"-(2"',5"'-disulfophenyl)amino-triazin-6"-yl]-amino-ethyl-amino}- 9,13-dichloro-4,11-disulfo-triphendioxazine, 3-amino-10-{[2'-chloro-4'-(2",5"-disulfophenyl)amino-triazin-6"-yl]}-amino-9,13-dichloro4,11-disulfo-triphendioxazine, 3-amino-10-{[2'-chloro-4'-(N-phenyl-3"-β-sulfatoethyl-sulfonyl-propyl)-amino-triazin-6'-yl]}-amino-9,13-dichloro4,11-disulfo-triphendioxazine, 3-amino-10-{[2'-chloro-4'-(2",5"-disulfophenyl)-amino-triazin-6'-yl]}-amino-9,13-dichloro-4,11-disulfo-triphendioxazine, and 3-amino-10-{[2'-chloro-4'-(3"-sulfophenyl)-amino-triazin-6'-yl]}-amino-9,13-dichloro-4,11-disulfo-triphendioxazine.

Suitable fiber materials in the context of the present invention are those which contain hydroxyl, amino, carboxamide and/or mercapto groups, such as cellulose fibers from the series consisting of naturally occurring cellulose, such as cotton of the most diverse origins, jute and ramie, regenerated fibers, such as viscose or chemically modified cellulose, such as cellulose modified by amino groups or cationic groups, or polyamide fibers, such as synthetic polyamides from the series consisting of polyamide 6 and polyamide 6,6, or protein fibers such as wool or silk, mixtures of the fiber types mentioned, and mixtures of cellulose with polyester, such as polyethylene terephthalatelcotton mixtures, application of the auxiliaries mentioned to cellulose-containing fiber materials being particularly preferred.

The carbohydrate compounds mentioned are particularly suitable for use in pad-dyeing processes, such as the cold pad-batch process, or continuous dyeing processes and textile printing processes, such as single-phase printing or discharge printing or the ink-jet process. Those processes which comprise applying a dyestuff and an alkaline padding liquor comprising alkali simultaneously are particularly preferred. Those processes in which very high dyestuff concentrations, for example 2 to 10% by weight of dyestuff, based on the dye liquor, or dyestuffs of limited solubility (less than 100 g/l) are applied under the use conditions without auxiliaries are furthermore particularly preferred.

In special cases, the carbohydrate compounds mentioned are also suitable as auxiliaries for exhaust dyeings, and in particular in the case where the dyestuffs employed have poor solubilities under the use conditions of an alkaline salt liquor, for example only 0.3 to 1% by weight of dyestuff, based on the dye liquor.

The present invention also relates to a dyestuff formulation comprising one or more fiber-reactive dyestuffs and one or more carbohydrate compounds of the formula (1).

A preferred embodiment of the dyestuff formulations according to the invention is a padding liquor comprising essentially 0.5 to 10% of a fiber-reactive dyestuff, 0.2 to 2% by weight, preferably 0.4 to 1.6% by weight, of one of the carbohydrate compounds defined above, an alkali, such as sodium hydroxide solution, sodium carbonate or waterglass, and if appropriate other customary auxiliaries and additives, so that the total makes 100% by weight.

For example, a padding liquor comprises 5 to 100 parts/l of a reactive dyestuff, 5 to 40 $cm^3$/l of 32.5% strength (38° Be) sodium hydroxide or 5 to 20 parts/l of sodium carbonate and 2 to 20 parts/l, preferably 4 to 16 parts/l, of a carbohydrate compound of the type mentioned, and if appropriate further auxiliaries, 0 to 130 parts/l, preferably 0 to 50 parts/l, of water-glass (37° to 60° Be), and hydrotropic auxiliaries, such as 0 to 50 g/l, preferably 0 g/l, of urea, and/or dispersing agents, such as, for example, condensation products of naphthalenesulfonic acids with formaldehyde.

The padding liquor is padded onto the fabric in the customary manner, the liquor being applied by means of a padding trough via a pair of rolls arranged horizontally and the squeeze-off rate being adjusted such that a liquor pick-up of 40 to 120%, preferably 50 to 90% for cotton or 80 to 100% for viscose, is achieved, and the dyestuff is then fixed. Fixing can be carried out by cold batching of the fabric, which has been batched up air-tight, at 20° to 35° C. in the course of 2 to 48 hours, preferably 3 to 26 hours, or by steaming the intermediately dried fabric at 90° to 150° C. in the course of 1 to 10 minutes, or by steaming the wet, padded fabric at 90° to 120° C. in the course of 30 seconds to 3 minutes, in a steamer customary in practice for the application processes described, and the fabric can then be after-treated in the customary manner, such as rinsed, and if appropriate washed in the presence of surfactants.

In the short-time pad-batch process, the stability of the padding liquor is often improved by application of water-glass, but this technique has certain disadvantages, such as, for example, deposition and encrustation of silicic acid on padding rolls or machine components (Textilpraxis Int. 39 (1984), 63; ibid. 153, 262, 269). With the application according to the invention of the carbohydrate compounds mentioned, dyeing can be carried out with a reduced amount of or entirely without water-glass, which means that the stability of the padding liquor is improved without the disadvantages mentioned.

The problems of pad dyeing of reactive dyestuffs lie, inter alia, in the stability of the alkaline padding liquors, which manifests itself by precipitation in the padder or by reduced coloristic tinctorial strength. The effect of reduced tinctorial strength is caused by hydrolysis of the reactive dyestuff, which is known to any expert. Surprisingly, however, it has now been found that the loss in tinctorial strength is reduced if the auxiliaries mentioned are used, which provides a considerable advantage in respect of process reliability and profitability. In the case of dyestuffs from the series consisting of phthalocyanine reactive dyestuffs, such as, in particular, the Cu and Ni phthalocyanines, this effect is particularly pronounced. Surprisingly, in individual cases, for example in the case where auxiliaries of the formula (1f) are used, an increase in the coloristic tinctorial strength after a padding liquor dwell time or standing time in the range from 5 to 20 minutes is even observed.

Another preferred embodiment of the dyestuff formulation according to the invention is a printing paste comprising essentially 0.5 to 10% of a fiber-reactive dyestuff, 0.2 to 2% by weight, preferably 0.4 to 1.6% by weight, of one of the carbohydrate compounds defined above and other customary auxiliaries, such as, in particular, thickeners and additives, such as sodium nitrobenzenesulfonate and/or water softeners, so that the total makes up 100% by weight.

For example, a printing paste which comprises 5 to 100 parts of a reactive dyestuff, 200 to 300 parts of water, 400 to 500 parts of a sodium alginate thickener, 4 to 30 parts by weight of alkali in the form of sodium carbonate or sodium bicarbonate and 2 to 20 parts of a carbohydrate compound of the type mentioned, and if appropriate further auxiliaries, such as 10 parts of sodium nitrobenzenesulfonate, is used for a printing process on cellular fabric. This printing paste is printed onto the fabric in the customary manner and fixing is then carried out at 90° to 155° C. in the course of 3 to 15 minutes in a steamer, which can be, for example, a festoon steamer, a continuous steamer or a star steamer, and the fabric is then after-treated in the customary manner, for example rinsed, and if appropriate washed in the presence of surfactants.

Another preferred embodiment of the dyestuff formulation according to the invention is an improved ink-jet ink, comprising essentially 4 to 10% by weight of a fiber-reactive dyestuff, 1 to 10% by weight, preferably 2 to 7% by weight, of one of the carbohydrate compounds defined above and other customary auxiliaries and additives, so that the total makes up 100% by weight.

For an ink-jet print, the ink applied comprises, for example, 4 to 10% by weight of a reactive dyestuff, 1 to 10% by weight of a carbohydrate compound of the formula (1), 5 to 10% by weight of a substance which prevents drying up, such as a polyglycol ether, and if appropriate a fungicidal agent, and 70 to 90% by weight of water. The storage stability of the ink-jet inks can be improved advantageously by application of the carbohydrate compounds mentioned.

The invention furthermore relates to dyestuff formulations which comprise the carbohydrate compounds mentioned, wherein the formulation essentially comprises 20 to 70% by weight of dyestuff, 0.2 to 10% by weight, preferably 2 to 8% by weight, of the carbohydrate compound, 10 to 60% by weight of a salt and customary standardizing agents, and if appropriate further auxiliaries, such as, for example, dust removal agents, condensation products of naphthalenesulfonic acid with formaldehyde and/or condensed phosphates. The dyestuff formulations can be prepared in a customary mixer and/or comminuting apparatus, such as a mill, or by spray-drying the aqueous solutions comprising the substances.

It is likewise remarkable that if certain carbohydrate compounds are used as auxiliaries, the dyestuff can be dissolved cold in the padding liquor, which provides advantages due to reduced energy costs compared with the customary hot-dissolving processes of the prior art. It is furthermore particularly surprising here that higher tinctorial strengths are obtained than by the customary methods of the prior art, which provides another use advantage.

The padding liquor can in general be prepared by a) initially introducing the auxiliary into hot water and sprinkling in the dyestuff or metering it in as a highly concentrated solution, and after cooling, adding alkali;

b) initially introducing hot water into the preparation vessel, sprinkling in the dyestuff or metering it in as a highly concentrated solution, and adding the auxiliary and alkali after cooling or during cooling;

c) dissolving the auxiliary and the dyestuff in water at temperatures of 15° to 40° C. for some time, while stirring, and adding a customary amount of lkali.

In the case of alkyl glucosides and aryl glucosides of the formula (1a) and (1b), the preferred procedure is variant c).

The dyestuff formulations have advantages in their solubility and the levelness of the dyeings and prints compared with the non-formulated dyestuffs. They differ in the use of a mixture in powder or granule form instead of a separate addition of the auxiliaries to the dyebath.

DE-A-2 412 964 states that the dyestuff of the formula (C.I. Reactive Blue 19)

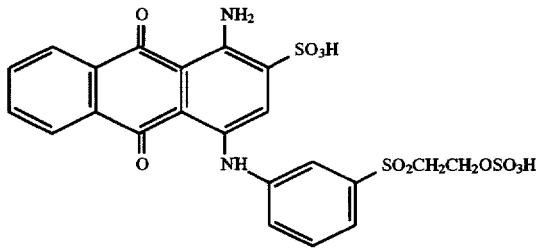

can be prepared as a dyestuff formulation in the presence of Na anthraquinone-2-sulfonate, which results in advantages for the solubility and levelness of the dyeings in deep shades. Instead of Na anthraquinone-2-sulfonate or a combination thereof with anthraquinone-2-sulfonic acid, the carbohydrate compounds according to the invention, if appropriate in combination with other auxiliaries, such as, for example, naphthalenesulfonic acid-formaldehyde condensates, can also be used for a C.I. Reactive Blue 19 dyestuff formulation. Dyestuff formulations which comprise 1 to 6% by weight, in particular 1.5 to 4% by weight, of the carbohydrate compounds of the formula (1), in particular (1h) and (1f), and 0 to 10% by weight of anthraquinone-2-sulfonic acid and/or the Na salt thereof are suitable here. Surprisingly higher color strengths can be achieved with the dyestuff formulations thus prepared, in particular by the exhaust dyeing process.

The activity of the compounds of the formula (1), in which the radical Z is a formula member (2a) or (2f) is particularly surprising because it is known from the literature that certain carbohydrate compounds, such as lower alkyl glucosides, for example methyl D-glucoside, and glucose (Luttringer & Dussy, Melliand Textilber. 62, 1981, 84) or sorbitol (Hildebrand: Venkataram VI. Reactive Dyes, Academic Press, 1972, page 335) react preferentially with fiber-reactive dyestuffs, and a reduction of the tinctorial strength would thus be expected during application of such compounds. Surprisingly, however, it has been found that this is not the case for the compounds of the formulae (2a) and (2f) mentioned, and in contrast, even an increase in the tinctorial strength is achieved in suitable dyeing processes when correctly chosen amounts are employed.

The following examples demonstrate the technical usefulness of the procedure according to the invention, which is advantageous in respect of the color strength of the resulting dyeings compared with the dyeing method of the prior art. The stability of padding liquors is particularly advantageously improved, as dyeings after various dwell times of the liquors before application demonstrate.

The amounts of the dyestuffs employed are calculated as customary formulations comprising, in particular, standardizing agent in the form of a salt, the actual dyestuff content of the dyestuff formulations being stated in parentheses.

Cotton which has been boiled off and bleached under alkaline conditions was used as the fiber material in the examples.

EXAMPLE 1:

2.0 parts (49.7%) of the dyestuff of the formula

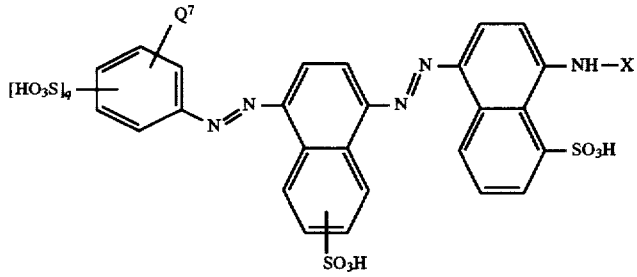

(C.I. Reactive Orange 16) are stirred into 100 parts of water with the addition of 3 parts of sodium sulfate at 40 to 50° C. 0.62 part of the aryl β-D-glucopyranoside compound of the formula

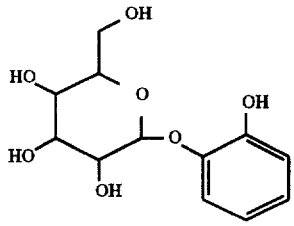

is then added and the mixture is stirred for some time. After cooling to 20°–25° C., 6 ml of a 6.5% strength by weight sodium hydroxide solution are then added. The padding liquor thus obtained is applied, after certain standing times $t_1$ or immediately ($t_1$=0) with a padder to cotton fabric under a squeeze-off pressure of 6.1 kg/cm$^2$ and a running speed of 1 m/minute, corresponding to a liquor pick-up of about 80%. The fabric is rolled up straight-edged and stored with exclusion of moisture for a certain dwell time ($t_2$), washed and dried. A strong orange dyeing is obtained. The following table shows the color strength obtained as the color strength parameter K/S in accordance with the method of Melliand Textilber. 1986, 562.

The color strengths obtained when dyeing is carried out in accordance with the urea method of the prior art (Textilpraxis Int. 39 (1984), 63; ibid. 153, 262, 269) are stated as the reference in order to document the advantageous procedure of the invention.

| Amount of dyestuff C.I. Reactive Orange 16 employed (49.7%) | Amount of 2-hydroxyphenyl β-D-glucopyranoside employed | $t_1$ | K/S Dwell time $t_2$ 4 hours/ 24 hours | Comparison with 100 g/l of urea 4 hours/ 24 hours |
|---|---|---|---|---|
| 20 g/l | 6.2 g/l | 0 min | 9.96/11.16 | 7.36/8.83 |
| " | " | 5 min | 7.80/9.87 | not possible |
| " | " | 15 min | 6.72/8.51 | not possible |

not possible: no dyeing is possible since the padding liquor precipitates, or only non-level dyeings are obtained.

EXAMPLE 2:

If a padding liquor of 40 g/l and 12.3 g/l of the 2-hydroxyphenyl β-D-glucopyranoside compound from Example 1 and 8 ml of NaOH (6.5% strength) is applied analogously to Example 1, the color results shown in the table are obtained.

| Amount of dyestuff C.I. Reactive Orange 16 employed (49.7%) | Amount of 2-hydroxyphenyl β-D-glucopyranoside employed | $t_1$ | K/S Dwell time $t_2$ 4 hours/ 24 hours | Comparison with 100 g/l of urea 4 hours/ 24 hours |
|---|---|---|---|---|
| 40 g/l | 12.3 g/l | 0 min | 12.04/15.46 | 9.44/13.30 |
| " | " | 5 min | 9.17/13.72 | not possible |

EXAMPLE 3:

If, instead of the glucoside compound from Example 1, a βD-glucopyranoside of the formula

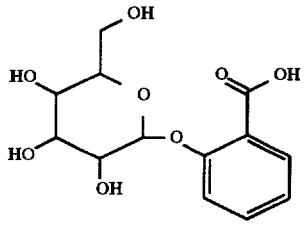

and dyestuffs in the amount shown in the following table are employed, dyeing being carried out with an amount of dyestuff employed of 20 g/l with 6 ml of sodium hydroxide solution (6.5% strength) and with 40 g/l with 8 ml of sodium hydroxide solution (6.5% strength), strong dyeings are likewise obtained.

| Amount of dyestuff employed | Amount of glucopyranoside employed | $t_1$ | K/S Dwell time $t_2$ 4 hours/ 24 hours | Comparison with 100 g/l of urea 4 hours/ 24 hours |
|---|---|---|---|---|
| 20 g/l of C.I. Reactive Orange 16 (49.7%) | 6.7 g/l of 2-carboxyphenyl β-D-gluco-pyranoside | 0 min | 11.49/11.46 | 7.36/8.83 |

-continued

| Amount of dyestuff employed | Amount of glucopyranoside employed | $t_1$ | K/S Dwell time $t_2$ 4 hours/ 24 hours | Comparison with 100 g/l of urea 4 hours/ 24 hours |
|---|---|---|---|---|
| 20 g/l of C.I. Reactive Orange 16 (49.7%) | 6.7 g/l of 2-carboxyphenyl β-D-gluco-pyranoside | 5 min | 8.91/11.04 | not possible |
| 20 g/l of C.I. Reactive Orange 16 (49.7%) | 6.7 g/l of 2-carboxyphenyl β-D-gluco pyranoside | 15 min | 6.06/9.99 | not possible |
| 40 g/l of C.I. Reactive Orange 16 (49.7%) | 13.5 g/l of 2-carboxyphenyl β-D-gluco pyranoside | 0 min | 12.11/16.56 | 9.44/13.30 |
| 40 g/l of C.I. Reactive Orange 16 (49.7%) | 13.5 g/l of 2-carboxyphenyl β-D-gluco pyranoside | 5 min | 9.80/16.02 | not possible |

EXAMPLE 4:

If, instead of the glucoside compound from Example 1, a carboxymethylated naphthyl glucoside of the formula

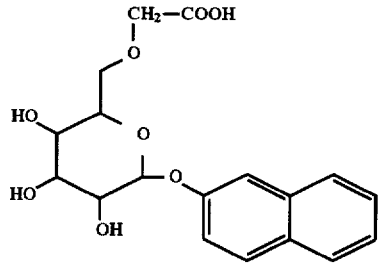

and dyestuffs in the amount shown in the following table are employed, dyeing being carried out with an amount of dyestuff employed of 20 g/l with 6 ml of sodium hydroxide solution (6.5% strength) and with 40 g/l with 8 ml of sodium hydroxide solution (6.5% strength), strong dyeings are likewise obtained:

| Amount of dyestuff employed | Amount of glucopyranoside employed | $t_1$ | K/S Dwell time $t_2$ 4 hours/ 24 hours | Comparison with 100 g/l of urea 4 hours/ 24 hours |
|---|---|---|---|---|
| 20 g/l of C.I. Reactive Orange 16 (49.7%) | 4.2 g/l | 0 min | 11.97/12.11 | 7.36/8.83 |
| 20 g/l of C.I. Reactive Orange 16 (49.7%) | 4.2 g/l | 5 min | 11.22/11.49 | not possible |
| 20 g/l of C.I. Reactive Orange 16 (49.7%) | 4.2 g/l | 15 min | 10.36/10.46 | not possible |
| 20 g/l of C.I. Reactive Orange 16 (49.7%) | 8.3 g/l | 0 min | 10.62/11.91 | 7.36/8.83 |
| 20 g/l of C.I. Reactive Orange 16 (49.7%) | 8.3 g/l | 5 min | 9.87/10.87 | not possible |
| 20 g/l of | 8.3 g/l | 15 min | 9.51/9.85 | not possible |

-continued

| Amount of dyestuff employed | Amount of glucopyranoside employed | $t_1$ | K/S Dwell time $t_2$ 4 hours/ 24 hours | Comparison with 100 g/l of urea 4 hours/ 24 hours |
|---|---|---|---|---|
| C.I. Reactive Orange 16 (49.7%) 20 g/l of C.I. Reactive Orange 16 (49.7%) | 12.5 g/l | 0 min | 11.52/11.81 | 7.36/8.83 |
| 20 g/l of C.I. Reactive Orange 16 (49.7%) | 12.5 g/l | 5 min | 10.60/10.87 | not possible |
| 20 g/l of C.I. Reactive Orange 16 (49.7%) | 12.5 g/l | 15 min | 9.85/10.26 | not possible |
| 40 g/l of C.I. Reactive Orange 16 (49.7%) | 16.7 g/l | 0 min | 16.32/17.33 | 9.44/13.30 |
| 40 g/l of C.I. Reactive Orange 16 (49.7%) | 16.7 g/l | 5 min | 14.84/16.68 | not possible |
| 40 g/l of C.I. Reactive Orange 16 (49.7%) | 16.7 g/l | 15 min | 14.40/16.02 | not possible |

EXAMPLE 5

2.0 parts of the dyestuff (37%) of the formula

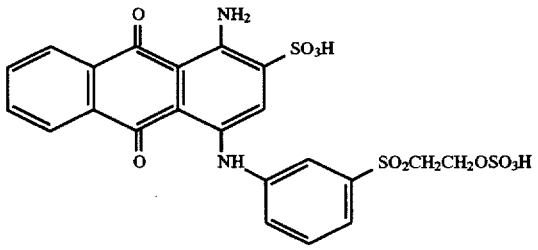

(C.I. Reactive Blue 19), comprising 5% by weight of anthraquinone-2-sulfonic acid, are stirred into 100 parts of water with the addition of 3 parts of sodium sulfate at 40°–50° C. 1 part of the carbohydrate compound of the formula

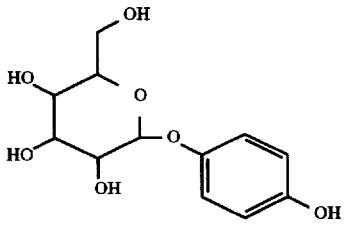

which is known by the name arbutin, is then added and the mixture is stirred for some time. After cooling to 20°–25° C., 1.2 ml of a 32% strength sodium hydroxide solution are added. The padding liquor thus obtained is applied, after certain standing times $t_1$ or immediately ($t_1$=0) with a roll padder to cotton fabric up to a squeeze-off rate corresponding to a liquor pick-up of 70%. The fabric is rolled up straight-edged, stored with exclusion of moisture for a dwell time of 24 hours, washed out several times and dried. Strong brilliant blue dyeings are obtained. 5 The following table shows the resulting color strengths as the weighted color strength parameter $\Sigma K/S(\lambda)$ in accordance with the method of Melliand Textilber. 1986, 562. The color strengths obtained when dyeing is carried out by the customary short-time pad-batch process (for example Textilpraxis Int. 39 (1984), 63; ibid. 153, 262, 269), the urea process, the normal process and the water-glass process, in order to document the advantageous procedure of the invention. The normal process is usually no longer used in current practice because of poor process reliability.

| Dyestuff | Time $t_2$/ min | Arbutin 10 g/l | Urea process | Water-glass process | Normal process |
|---|---|---|---|---|---|
| 40 g/l of C.I. Reactive Blue 19 | 0 | 79.63 | 63.47 | 67.39 | 64.33 |
| 40 g/l of C.I. Reactive Blue 19 | 10 | 75.11 | 62.64 | 63.74 | 58.83 |

Reference dyeings:

The urea process padding liquor comprises 100 g/l of urea instead of the carbohydrate compound. The water-glass process padding liquor comprises 100 g/l of urea and 95 g/l of water-glass (20° Be) instead of the carbohydrate compound; normal process: without water-glass and urea.

Non-formulated C.I. Reactive Blue 19 gives speckled dyeings on the stated substrate under the conditions applied.

EXAMPLE 6

If the procedure is as in Example 5 and 1 part of a customary sophorose lipid mixture is used as the auxiliary instead of arbutin, level, strong brilliant blue dyeings having the color strengths as stated in the table are obtained.

| Dyestuff | Time $t_2$/ min | Disaccharide 10 g/l | Urea process | Water-glass process | Normal process |
|---|---|---|---|---|---|
| 40 g/l C.I. Reactive Blue 19 | 0 | 73.71 | 63.47 | 67.39 | 64.33 |
| 40 g/l C.I. Reactive Blue 19 | 10 | 71.18 | 62.64 | 63.74 | 58.83 |

EXAMPLE 7

If the procedure is as in Example 5, but the Cu phthalocyanine dyestuff of the formula

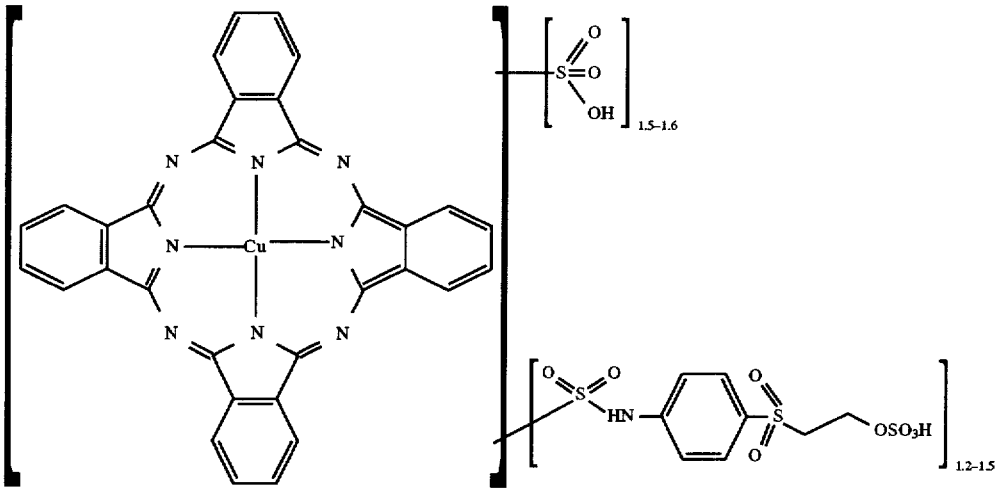

is used instead of C.I. Reactive Blue 19, strong turquoise blue dyeings are obtained.

The following table shows the resulting color strengths as the weighted color strength parameter ΣK/S(λ) in accordance with the method of Melliand Textilber. 1986, 562. The color strengths obtained when dyeing is carried out by the customary short-time pad-batch process (cf. Example 5) are stated as a reference in order to document the advantageous procedure of the invention.

| Amount of dyestuff employed (39%) | Time $t_2$/ min | Arbutin 10 g/l | Urea process | Water-glass process |
|---|---|---|---|---|
| 40 g/l | 0 | 49.97 | 34.34 | 39.92 |
| " | 10 | 49.96 | 31.84 | 38.67 |
| 20 g/l | 0 | 28.96 | 19.23 | 24.17 |
| " | 10 | 26.29 | 20.06 | 22.93 |

EXAMPLE 8:

If the procedure is as in Example 7, but instead of arbutin the carbohydrate compound from Example 6 is used, level deep turquoise blue dyeings having the color strength as stated in the table are likewise obtained:

| Amount of dyestuff employed (39%) | Time $t_2$/ min | Disaccharide from Example 6 10 g/l | Urea process | Water-glass process |
|---|---|---|---|---|
| 40 g/l | 0 | 44.40 | 34.34 | 39.92 |
| " | 10 | 44.29 | 31.84 | 38.67 |
| 20 g/l | 0 | 25.63 | 19.23 | 24.17 |
| " | 10 | 23.59 | 20.06 | 22.93 |

EXAMPLE 9

4 parts of the dyestuff (43%) of the formula

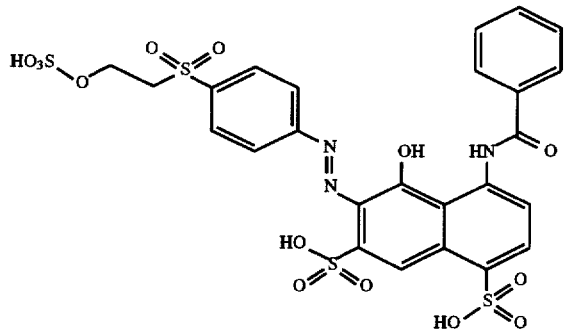

are stirred into 100 parts of water with the addition of 3 parts of sodium sulfate at 40 to 50° C. 1 part of the carbohydrate compound characterized in the table is then added and the mixture is stirred for some time. 1.2 ml of a 32% strength sodium hydroxide solution are then added, after cooling to 25° C. The padding liquor thus obtained is applied, after certain standing times $t_1$ or immediately ($t_1$=0), with a padder to cotton fabric up to a squeeze-off rate corresponding to a liquor pick-up of 70%. The fabric is rolled up straight-edged, stored with exclusion of moisture for a dwell time of 24 hours, washed and dried. Strong brilliant red dyeings are obtained. The following table shows the color strength obtained as the weighted color strength parameter ΣK/S(λ) (cf. Example 5).

| Amount of dyestuff employed | Time $t_2$/ min | Arbutin 10 g/l | Disaccharide from Example 6 10 g/l | Urea process | Water-glass process |
|---|---|---|---|---|---|
| 20 g/l | 0 | 50.67 | 53.26 | 45.92 | 46.54 |
| " | 10 | 40.07 | 40.24 | 38.50 | 40.8 |

EXAMPLE 10

If a padding liquor comprising the dyestuffs mentioned in the following table in the stated amount and carbohydrate compounds in the amounts employed stated in the table, as auxiliaries, is employed analogously to Example 1 without using urea, the color results shown in the table are obtained. Dyeings which have been carried out without an auxiliary but with 100 g/l of urea are shown as a comparison.

a liquid, are added to this solution. The mixture is stirred at a pH of 5 to 6 and a temperature of 20° to 25° C. for some

TABLE

| Dyestuff (Structural formula) | Amount of dyestuff employed g/l | Auxiliary amount employed | $t_1$ | Color strength K/S after $t_2$; 24 hours | Comparison fixing time of 24 hours |
|---|---|---|---|---|---|
| 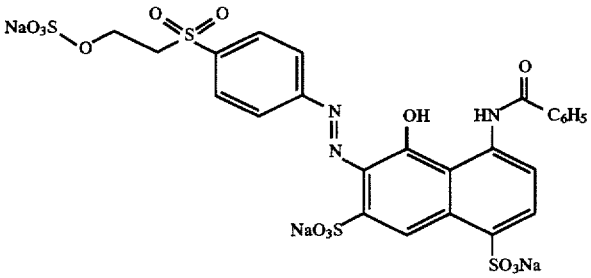 | 20 | 1.15 g/l C12/14 GA* | 0 | 55.4 | 46.0 |
| | 40 | 1.15 g/l C12/14 GA* | 0 | 100.6 | 87.5 |
| | 20 | 0.22 g/l C16/18 GA* | 0 | 53.1 | 46.0 |
| | 40 | 0.22 g/l C16/18 GA* | 0 | 100.5 | 87.5 |
| 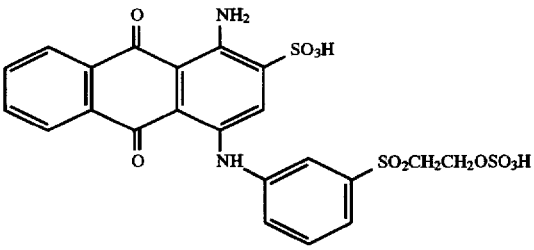 | 40 | 1.15 g/l C12/14 GA* | 0 | 74.4 | 63.5 |
| | 40 | " | 10 | 63.2 | 62.6 |
| | 40 | 0.22 g/l C16/18 GA** | 0 | 71.5 | 63.5 |
| | 40 | " | 10 | 63.1 | 62.6 |
| | 40 | 6.3 g/l dodecyl β-D-glucopyranoside | 0 | 68.7 | 63.5 |
| | | | 10 | 64.2 | 62.6 |
| | | | 15 | 64.4 | — |
| | 40 | 10 g/l carboxy-methylated naphthyl glucoside (as Example 4) | 0 | 86.0 | 63.5 |
| | | | 10 | 77.6 | 62.6 |
| Reactive Blue 19 formulation comprising 9% by weight of anthraquinone-2-sulfonic acid. Non-formulated Reactive Blue 19 produces speckled dyeings | | | | | |
| 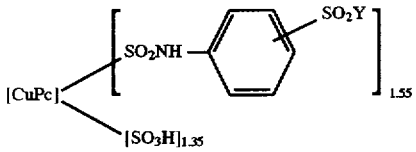 39% | 20 | 1.15 g/l C12/14 GA* | 0 | 28.1 | 26.0 |
| | | | 5 | 29.5 | 22.6 |
| | | | 10 | 30.3 | 20.4 |
| | 40 | " | 0 | 46.2 | 49.3 |
| | | | 5 | 50.8 | 47.9 |
| | | | 10 | 53.4 | 45.3 |
| | 20 | 0.22 g/l C16/18 GA** | 0 | 28.2 | 26.0 |
| | | | 5 | 28.5 | 22.6 |
| | | | 15 | 29.1 | 18.7 |
| | 40 | " | 0 | 44.8 | 49.3 |
| | | | 5 | 48.6 | 47.9 |
| | | | 15 | 52.1 | 42.8 |
| 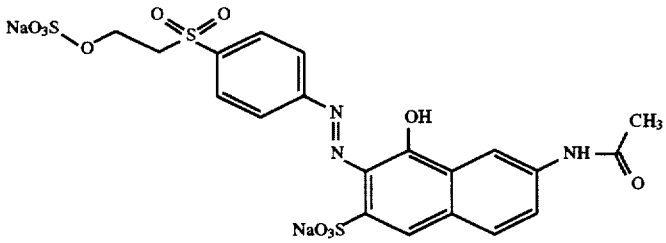 49.7% | 20 | 1.15 g/l C12/14 GA* | 0 | 85.7 | 60.3 |
| | 20 | 0.22 g/l C16/18 GA** | 0 | 74.8 | 60.3 |
| | 40 | 10 g/l octyl-D-glucopyranoside (mixture of α- and β-anomers) | 0 | 148 | 144 |
| | | | 10 | 143 | 142 |
| | | | 15 | 140 | 136 |

Color strength = K/S according to Melliand, Y = 2-sulfatoethylsulfonyl
*GA 12/14 = mixture of fatty acid N-methyl-glucamides in a weight ratio of 3.2:1 C12:C14
**GA 16/18 = mixture of fatty acid N-methyl-glucamides in a weight ratio of 1.7:1 C16:C18
CuPc = copper complex pthalocyanine

EXAMPLE 11

1 kg of dyestuff powder of the dyestuff shown in the following table are dissolved in 2.5 l of water. Xg of the carbohydrate compound shown in the table, in aqueous solution, in aqueous suspension, dissolved in a solvent or as time and the product is isolated by evaporation at 60° C. under reduced pressure.

A dyestuff formulation which shows advantages in the coloristic color strength in dyeings on cellulose fibers, with the color results stated in the table, is obtained. Level, strong, brilliant dyeings having good fastness properties are obtained.

The K/S color strength is stated as the color strength parameter, the amount employed for the dyeings within a series of the same dyestuff being standardized in terms of transmission to the same tinctorial strength in the dye liquor and thus being directly comparable.

TABLE

| Dyestuff formulation amount employed | Amount of auxiliary employed in g (= x) per kg of dyestuff formulation | Dyeing conditions g/l of $Na_2SO_4$, g/l of sodium carbonate/ml/l of NaOH 38° Be | Dyeing temperature °C. | Color strength Σ K/S |
|---|---|---|---|---|
| Color results of dyestuff formulations (exhaust dyeings on cotton fabric, liquor ratio 1:10) | | | | |
| C.I. Reactive Blue 19 | | | | |
| 2.93% | 40 g/kg of GA 12/14 | 50/5/2 | 40 | 114.7 |
| 3.21% | 80 g/kg of GA 12/14 | 50/5/1 | 60 | 88.1 |
| 2.81% | 20 g/kg of GA 12/14 | 50/5/0 | 80 | 78.5 |
| C.I. Reactive Blue 19 | | | | |
| 2.81% | 20 g/kg of GA 16/18 | 50/5/2 | 40 | 105.3 |
| 3.21% | 40 g/kg of GA 16/18 | 50/5/1 | 60 | 102.5 |
| C.I. Reactive Blue 19 | | | | |
| 2.94% | 40 g/kg of sophorose lipid | 50/5/2 | 40 | 121.9 |
| 2.94% | 40 g/kg of sophorose lipid | 50/5/1 | 60 | 112.0 |
| 2.94% | 40 g/kg of sophorose lipid | 50/5/0 | 80 | 86.0 |
| Color results in the cold pad-batch process, 25° C., dwell time 24 hours, dyeing process as Example 1 without urea | | | | |
| C.I. Reactive Blue 19 | | | | |
| 41.9 g/l | 40 g/kg of sophorose lipid | as Example 1 | as Example 1 | 86.3 |
| 42.7 | 60 g/kg of sophorose lipid | | | 85.5 |
| 50.7 | 80 g/kg of sophorose lipid | | | 72.6 |
| C.I. Reactive Blue 19 | | | | |
| 41.9 g/l | 40 g/kg of GA 12/14 | as Example 1 | as Example 1 | 77.8 |
| 39.9 g/l | 40 g/kg of GA 16/18 | | | 81.8 |
| 41.9 g/l | 60 g/kg of GA 16/18 | | | 89.9 |

GA 12/14 = Mixture of fatty acid N-methyl-glucamides in a weight ratio of 3.2:1 C12:C14
GA 16/18 = Mixture of fatty acid N-methyl-glucamides in a weight ratio of 1.7:1 C16:C18
Non-formulated C.I. Reactive Blue 19 was used as a comparison, but gave speckled dyeings which could not be measured by reflective spectrometry, so that no direct comparison is possible.

We claim:

1. A method of dyeing or printing textile fiber materials with fiber-reactive dyestuffs compromising the step of incorporating into an aqueous dyestuff formulation employed for said dyeing or printing process, as an auxiliary, a carbohydrate compound wherein the carbohydrate compound is one or more compounds of the formulae

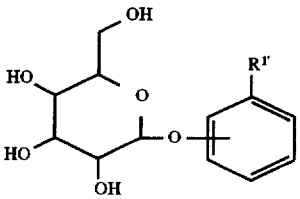

(1a)

-continued

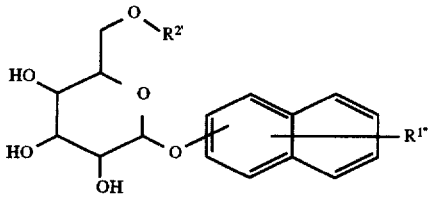

(1b)

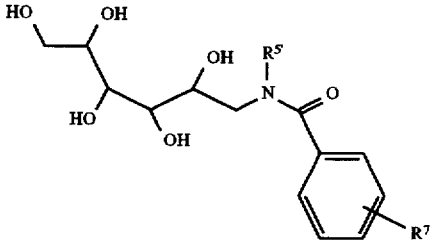

(1c)

-continued (1d)

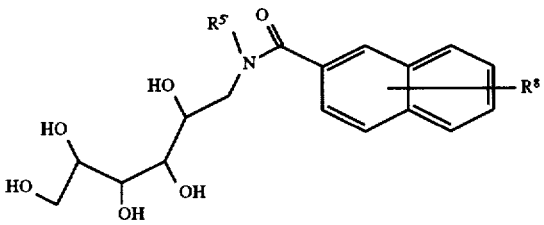

(1e)

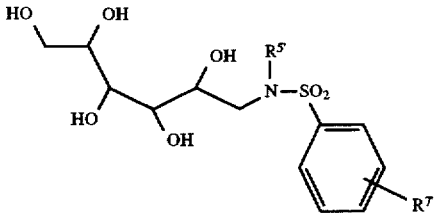

(1f)

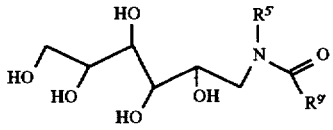

(1g)

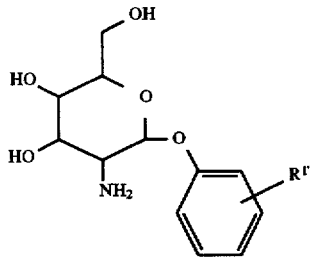

(1h)

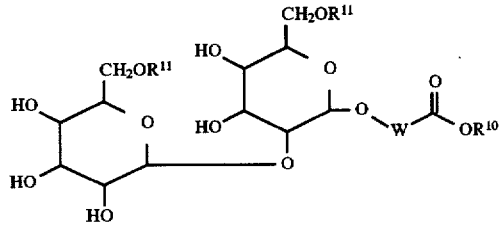

(1i)

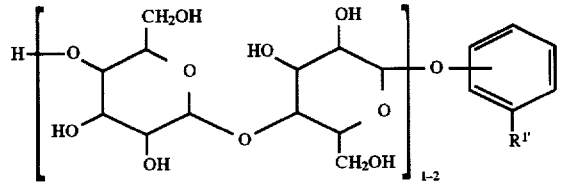

(1j)

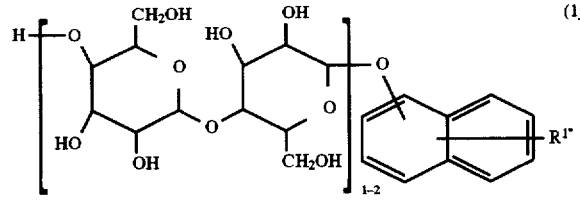

-continued (1k)

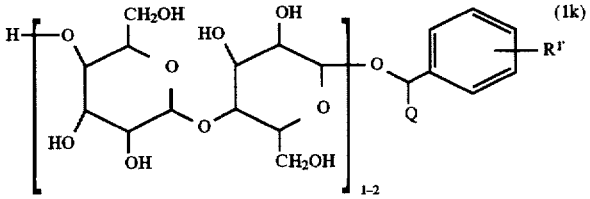

in which $R^{1'}$ is hydrogen, hydroxyl, $COOCH_3$' $COOC_2H_5$ or carboxyl;

$R^{2'}$ is hydrogen, acetyl or carboxymethyl;

$R^{1''}$ is hydrogen, hydroxyl, sulfo or carboxyl;

$R^{5'}$ is hydrogen or methyl $R^7$ is hydroxyl or hydrogen;

$R^{7'}$ is hydroxyl, methyl or hydrogen;

$R^8$ is hydroxyl or hydrogen;

$R^{9'}$ is $C_7$–$C_{20}$-alkyl, which optionally contain 1 to 3 olefinic double bonds;

W is $C_{13}$–$C_{19}$-alkylene, which optionally contain 1 to 8 olefinic double bonds and are optionally branched;

$R^{10}$ is hydrogen or methyl;

$R^{11}$ is hydrogen or acetyl; and

Q is hydrogen, cyano or carboxyl.

2. The method as claimed in claim 1, wherein $R^{1''}$ and the pyranosyl radical are in the 2,3- or 2,6-position relative to one another;

$R^{7'}$ is in the ortho- or para-position relative to the sulfonyl group;

R8 and the saccharylaminocarbonyl radical are in the 2,3- or 2,6-position relative to one another; and W is a $C_{17}$-alkylene.

3. The method as claimed in claim 1, wherein the fiber-reactive dyestuff is a dyestuff selected from the group consisting of monoazo, bisazo, polyazo, metal complex azo, anthraquinone, metal complex formazan, metal complex phthalocyanine and triphendioxazine dyestuffs.

4. The method as claimed in claim 1, wherein the fiber material is or comprises cellulose fibers, regenerated cellulose fibers, cellulose fibers modified by amino groups or cationic groups, polyamide fibers, a mixture of the fibers mentioned or a mixture of cellulose fibers and polyester fibers.

5. The method as claimed in claim 1, wherein dyeing is carried out by a pad-dyeing process and printing is carried out by a single-phase printing, discharge printing or the ink-jet process.

* * * * *